US005784989A

United States Patent [19]

Shimizu et al.

[11] Patent Number: 5,784,989

[45] Date of Patent: Jul. 28, 1998

[54] SEWING MACHINE HAVING THREAD CUTTING MECHANISM

[75] Inventors: Masaki Shimizu, Toyoake; Akio Takahashi, Gifu, both of Japan

[73] Assignee: Brother Kogyo Kabushiki Kaisha, Nagoya, Japan

[21] Appl. No.: 807,686

[22] Filed: Feb. 28, 1997

[30] Foreign Application Priority Data

Mar. 11, 1996 [JP] Japan ..... 8-083356

[51] Int. Cl.[6] ..... D05B 65/02; D05B 19/12

[52] U.S. Cl. ..... 112/300

[58] Field of Search ..... 112/300, 291, 112/292, 293, 294, 295, 221

[56] References Cited

U.S. PATENT DOCUMENTS 4,690,081 9/1987 Castagna et al. ..... 112/221 X
5,133,272 7/1992 Hayashi ..... 112/221
5,156,506 10/1992 Suzuki et al. ..... 112/300 X
5,623,887 4/1997 Tajima et al. ..... 112/300 X

*Primary Examiner*—Peter Nerbun
*Attorney, Agent, or Firm*—Oliff & Berridge PLC

[57] ABSTRACT

A sewing machine capable of cutting only a needle thread without cutting a bobbin thread during the middle of stitching operation for changing the needle thread with another needle thread. A thread cutting motor is driven independent of a sewing machine motor. A rotary hook control unit is provided for controlling rotation of a rotary hook as well as driving mode of the thread cutting motor in relation to a rotation of a spindle. A thread cutting mechanism including a movable blade pivotably driven by the thread cutting motor is provided between the rotary hook and a throat plate. If the movable blade is moved from its maximum pivot position to a stand-by position, both needle thread and bobbin thread are cut at the final number of stitch. If the movable blade is moved from a needle thread cutting position to the stand-by position, only the needle thread can be cut.

16 Claims, 26 Drawing Sheets

SEWING MACHINE HAVING THREAD CUTTING MECHANISM

BACKGROUND OF THE INVENTION

The present invention relates to a sewing machine having a thread cutting mechanism, and more particularly, to a type thereof in which only a needle thread can be cut in a temporary stop of the stitching operation, so that a subsequent stitch can be stably formed after re-starting the stitching operation.

In a conventional sewing machine, a main body includes a bed portion, a leg portion, an arm portion and a head portion. A spindle driven by a sewing machine motor is provided in the arm portion, and a needle bar, a needle and a thread take-up lever provided in the head portion, and the needle bar is reciprocally moved vertically by the driving force of the spindle. In the bed portion, a lower shaft and a rotary hook are provided. The lower shaft is also rotationally driven by the spindle. That is, the lower shaft is driven by the spindle in order to synchronize the sewing needle with the rotary hook.

For embroidery stitching with various colors, a plurality of colored threads are used in a multiple head type embroidery machine. In the embroidery machine, a plurality of needle bars are selectively driven, and a thread cutting mechanism including a movable blade and a stationary blade is provided at a position between a throat plate and the rotary hook for simultaneously cutting a needle thread and a bobbin thread. Further, a driving mechanism is provided for driving the thread cutting mechanism in synchronism with the spindle.

In the conventional multiple head type embroidery machine having the thread cutting mechanism and the driving mechanism therefor, the thread cutting mechanism is driven in synchronization with the spindle, and the movable blade is moved by a predetermined distance at a predetermined rotational timing of the spindle for simultaneously cutting the needle and bobbin threads. However, in the middle of the embroidery stitching, both needle thread and bobbin thread are cut at the time of the thread changing operation in the temporary stitch stopping period. Therefore, at the re-starting phase of the stitching operation after changing the thread with a thread of different color, a seam may not be formed due to the insufficient engagement between the needle thread and the bobbin thread.

SUMMARY OF THE INVENTION

It is therefore an object of the present invention to provide a sewing machine capable of cutting only the needle thread without cutting the bobbin thread in the thread cutting operation performed in the middle of the stitching operation, stabilizing the formation of a seam or stitch after restarting of the stitching operation.

This and other objects of the present invention will be attained by a sewing machine for stitching a workpiece fabric with a needle thread and a bobbin thread including a sewing machine motor, a spindle driven by the sewing machine motor for driving a needle, a bed having a throat plate, a rotary hook provided in the bed for trapping a needle thread loop in cooperation with the needle, a thread cutting mechanism disposed below the throat plate for cutting the needle thread and the bobbin thread, an actuator for driving the thread cutting mechanism independent of the sewing machine motor, and control means for controlling the actuator so that only a needle thread, stitched into and extending from the work piece fabric is cut by the thread cutting mechanism without cutting the bobbin thread.

DETAILED DESCRIPTION OF THE PREFERRED EMBODIMENTS

A sewing machine according to one embodiment of the present invention will be described with reference to accompanying drawings.

Figure 1:
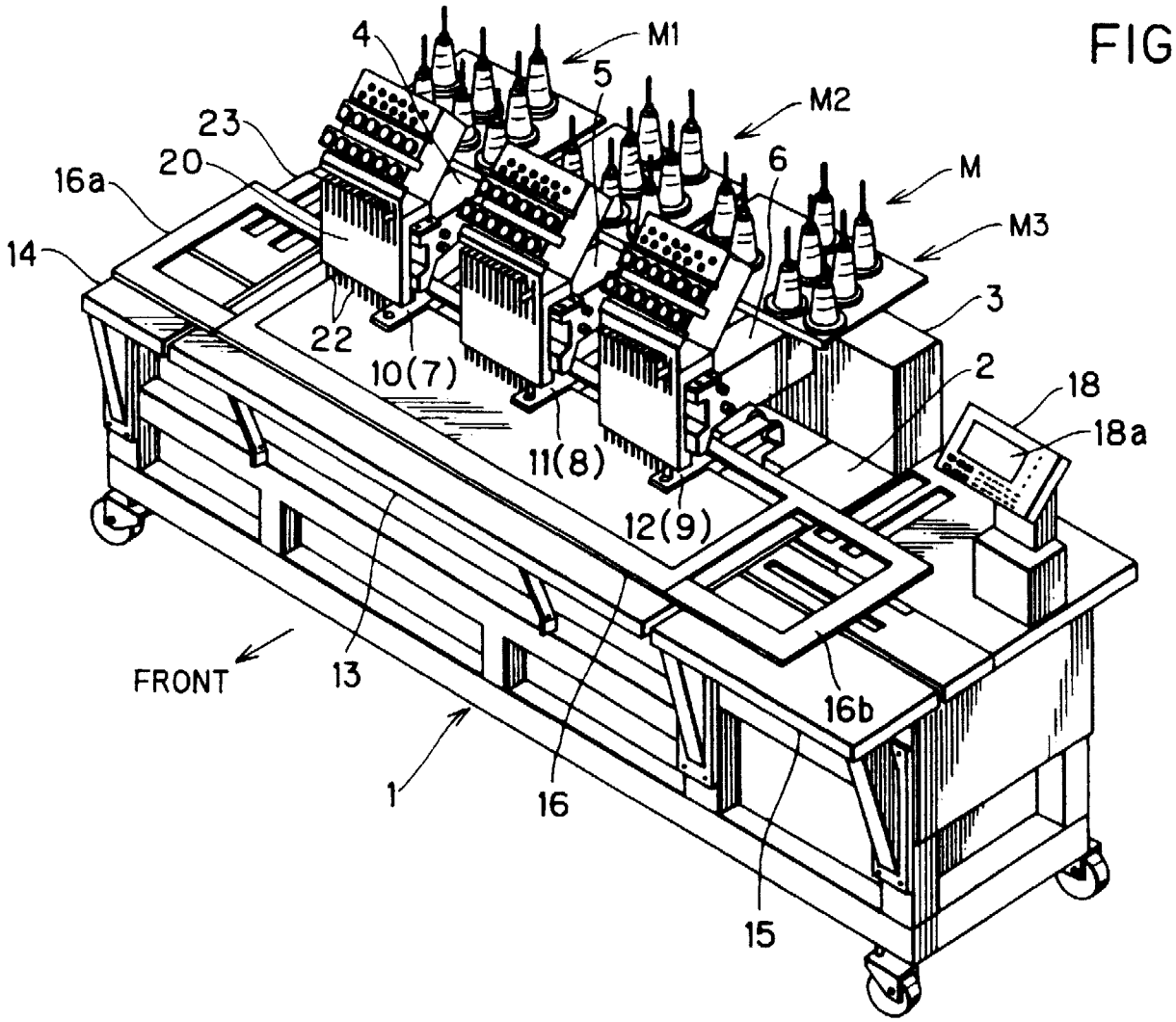
FIG. 1 is a perspective view showing a multiple head type embroidery machine according to one embodiment of the present invention.

As shown in FIG. 1, the embodiment concerns a multiple head type embroidery machine M in which three multiple needle type embroidery machines M1, M2, M3 are juxtaposedly arrayed, and each embroidery machine includes a rotary hook rotatably driven by a rotary hook drive motor independent of a sewing machine motor.

As shown in FIG. 1, the multiple head type embroidery machine M includes a laterally extending base frame 1. The base frame 1 has an upper rear surface provided with a laterally extending sewing machine supporting plate 2 having a rectangular shape in a plan view. Further, a laterally extending support frame 3 upstands from a rear portion of the sewing machine supporting plate 2. On the support frame 3, three head portions 4 through 6 are juxtaposed side by side with a predetermined space therebetween. On the base frame 1 and at a position in front of the sewing machine supporting plate 2, each rear end portion of bed 7, 8, 9 constituted in each bed unit 10, 11, 12 are supported at a position corresponding to the head portions 4, 5, 6, respectively.

Thus, three multiple needle type embroidery machines M1, M2, M3 are provided by the head portions 4, 5, 6 provided on the support frame 3 and corresponding bed units 10, 11, 12 in a side by side relation. Each head portion 4, 5, 6 is mechanically independent of each corresponding bed unit 10, 11, 12, and bed units 10,11,12 are mechanically independent of one another.

At the front end portion of each head portion 4,5,6 of the embroidery machines M1, M2, M3, a needle bar case 20 is laterally movably supported. In each needle bar case 20, twelve needle bar 21 arrayed in the lateral direction are vertically movably supported and twelve thread take-up levers 23 are pivotably supported. These needle bar cases 20 are concurrently moved laterally by a needle bar changing mechanism (not shown) driven by a needle bar changing motor 115 (FIG. 8) in order to concurrently change color of the threads for the embroidery stitching.

A work table 13 extends in a horizontal direction at a position in front of the sewing machine supporting plate 2. The height of the work table 13 can be changed, and can be coincident with the height of an upper surface of the bed units 10, 11, 12. If embroidery sewing is to be performed on a cup shaped article such as a hat or cap, the work table 13 is lowered, so that each outer contour of the bed unit 10, 11, 12 can be surrounded by the cup shaped article to be stitched.

A pair of auxiliary tables 14, 15 are provided at lateral ends of the work table 13. Further, a movable frame 16 having a rectangular shape and extending in the lateral direction is mounted on the pair of auxiliary tables 14, 15.

Figure 8:
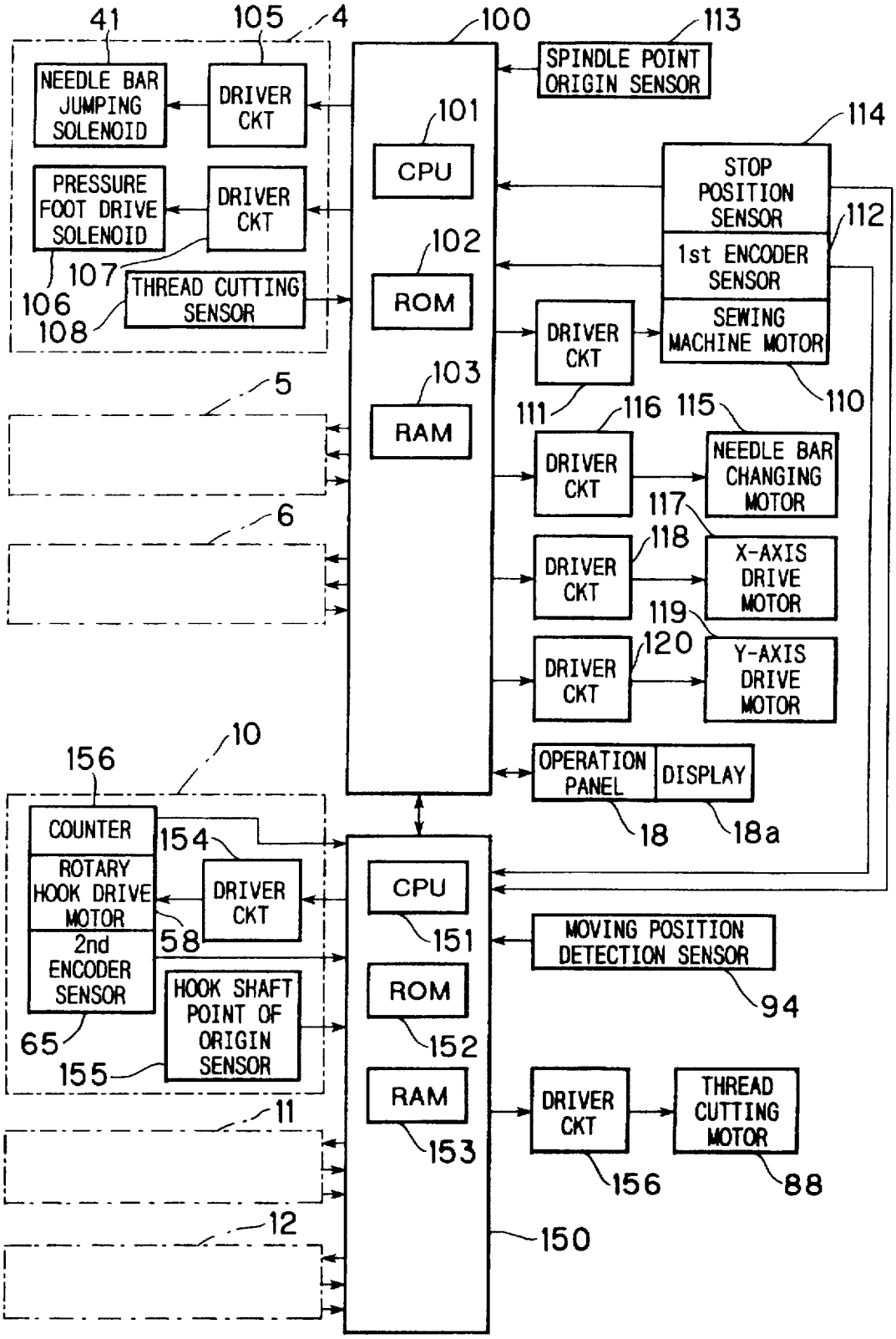
FIG. 8 is a block diagram showing a control system of the multiple head type embroidery machine according to the embodiment.

The movable frame 16 has a left end portion serving as a driving frame portion 16*a* which is movable in an X-axis direction, i.e., the lateral direction (rightwardly and leftwardly in FIG. 1) by an X-axis drive mechanism (not shown). Further, the movable frame 16 has a right end portion serving as another driving frame portion 16*b*. These driving frame portions 16*a* and 16*b* are movable in a Y-axis direction( frontwardly and rearwardly in FIG. 1) by a Y-axis drive mechanism (not shown). Accordingly, the movable frame 16 is movable in a X-Y plane by the X-axis drive mechanism driven by an X-axis drive motor 117 (FIG. 8) and the Y-axis drive mechanism driven by a Y-axis drive motor 119 (FIG. 8). Further, at the rear side of the auxiliary table 15, an operation panel 18 is provided for inputting various commands. The operation panel 18 includes a display 18*a* for displaying a message in connection with the embroidery stitching.

Next, a needle bar driving mechanism 25 for vertically moving needle bars 21 will be described with reference to FIG. 2. The needle bar driving mechanism 25 is provided in each of the embroidery machines M1, M2, M3.

At the front end portion of each of the head portions 4, 5, 6, a master needle bar 26 extending in the vertical direction is provided. Upper and lower end portions of the master needle bar 26 is supported to a frame F of the needle bar case 20. A vertically movable segment 27 is movably supported to and around the master needle bar 26. The movable segment 27 is formed with an engagement groove 27*a* engageable with a linking pin 34 described later. The movable segment 27 has a lower end portion provided with a needle bar embracing segment 28 which is vertically movable and unrotatable relative to the master needle bar 26. The needle bar embracing segment 28 is connected to a link 31 pivotally connected to a swing lever 30 pivotably supported about a pivot shaft 29. The movable segment 27 is rotatable with respect to the needle bar embracing segment 28.

A single sewing machine spindle 17 extends in the lateral direction through the head portions 4, 5 and 6. The spindle 17 is driven by a sewing machine motor 110 (FIG. 8). An eccentric cam 32 is fixedly mounted on the spindle 17, and an eccentric lever 33 is disposed over the eccentric cam 32. The eccentric lever 33 has a lower end pivotally connected to the swing lever 30.

Each lower end portion of each of the twelve needle bars 21 is provided with a sewing needle 22, and each needle bar 21 has an intermediate portion fixed with a linking pin 34. A compression spring 35 is disposed around the needle bar 21 and interposed between the linking pin 34 and the support frame F of the needle bar case 20, so that the needle bar 21 is urged to its upper needle position by the biasing force of the compression spring 35. Further, each one of the linking pins 34 of each one of the needle bars 21 can be selectively engaged with the engagement groove 27*a* of the vertically movable segment 27 when the needle bar case 20 is moved in the lateral direction.

With this arrangement, upon rotation of the sewing machine motor 110 in a predetermined rotational direction, the spindle 17 is rotated about its axis, so that the vertically movable segment 27 and the needle bar embracing segment 28 are integrally reciprocally moved in the vertical direction by way of the eccentric lever 33, the swing lever 30 and the link 31. As a result, only one of the needle bars 21 engaged with the vertically movable segment 27 through the linking pin 34 is vertically reciprocally moved in a timed relation with the rotation of the spindle 17.

Next, a needle bar jumping mechanism 40 will also be described with reference to FIG. 2. This mechanism 40 is provided in each of the embroidery machines M1, M2, M3 and is adapted to jump the needle bar 21 to its uppermost position or upper dead point.

Within the needle bar case 20, a needle bar jumping solenoid 41 is provided. The solenoid 41 has a plunger extending in the horizontal direction. Further, an angularly movable L-shaped lever 42 is provided in the needle bar case 20. The L-shaped lever 42 has and L-shape configuration as viewed in a plan view, and is pivotable about a vertical axis. The L-shaped lever 42 has a drive portion 42*a* abuttable on an end of the plunger of the solenoid 41. The L-shaped lever 42 has a driven portion 42*b* provided with an operation shaft 43 extending in the vertical direction. The above described vertically movable segment 27 integrally provides a protruding engaging portion 27*b*, and the operation shaft 43 is engageable with the engaging portion 27*b*.

Further, a torsion coil spring 44 is connected to an upper end portion of the vertically movable segment 27 so as to normally urge the vertically movable segment 27 to its linking position shown by a solid line where the linking pin 34 is engaged with the engagement groove 27*a*. Incidentally, a two dotted chain line indicates a jumping position of the vertically movable segment 27 as a result of counterclockwise rotation of the vertically movable segment 27.

Figure 2:
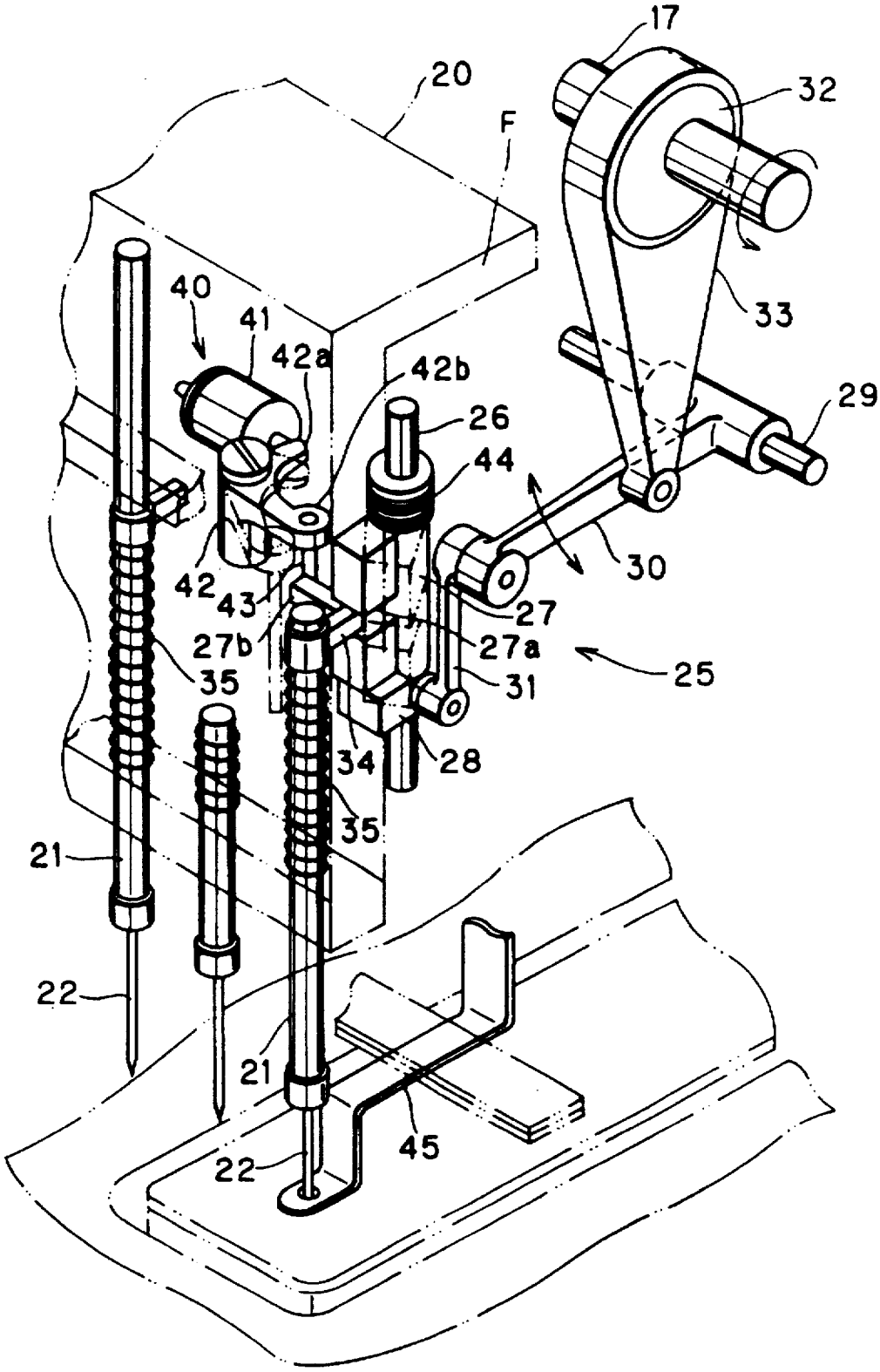
FIG. 2 is a schematic perspective view showing a needle bar vertical moving mechanism including a needle bar jumping mechanism according to the embodiment.

With this structure, if the needle bar jumping solenoid 41 is actuated for a predetermined period to extend its plunger rightwardly in FIG. 2 when the needle bar 21 is connected to the vertically movable segment 27 by way of the linking pin 34, the pivotable lever 42 is angularly moved in a clockwise direction in FIG. 2. Therefore, the operation shaft 43 pushes the protruding engaging portion 27*b* in the counterclockwise direction in FIG. 2. Thus, the vertically movable segment 27 is pivotally moved to the jumping position indicated by the two-dotted chain line against the biasing force of the coil spring 44. Consequently, the linking pin 34 is disengaged from the engagement groove 27*a*, and at the same time, the needle bar 21 is promptly moved to its uppermost position, i.e., the needle bar 21 performs the jumping operation by the biasing force of the compression spring 35.

On the other hand, if the vertically movable segment 27 is moving upwardly from its lower position to its uppermost position in a state where the needle bar 21 has the uppermost position as a result of the jumping operation while the vertically movable segment 27 restores its linking position, the vertically movable segment 27 is firstly brought into abutment with the lower surface of the linking pin 34, and is temporarily pivotally moved about the master needle bar 26 to the jump position indicated by the two dotted chain line. However, because of the biasing force of the coil spring 44, the vertically movable segment 27 is promptly angularly moved to its linking position indicated by the solid line, so that the linking pin 34 can be automatically brought into engagement with the engagement groove 27*a*.

Incidentally, each of the bed portions 7, 8, 9 is provided with a pressure foot 45. The position of the pressure foot 45 can be changed between a pressing position where the pressure foot 45 depresses a workpiece fabric W on the associated bed portion and a retracting position positioned above the pressure position by a predetermined distance. A pressure foot drive mechanism (not shown) is provided Including a pressure foot drive solenoid 106 (FIG. 8) for changing the position of the pressure foot.

Next, the bed units 10, 11, 12 will be described with reference to FIGS. 3 through 7. These bed units are identical with one another, and therefore, description will be made of the leftmost bed unit 10 only.

Figure 3:
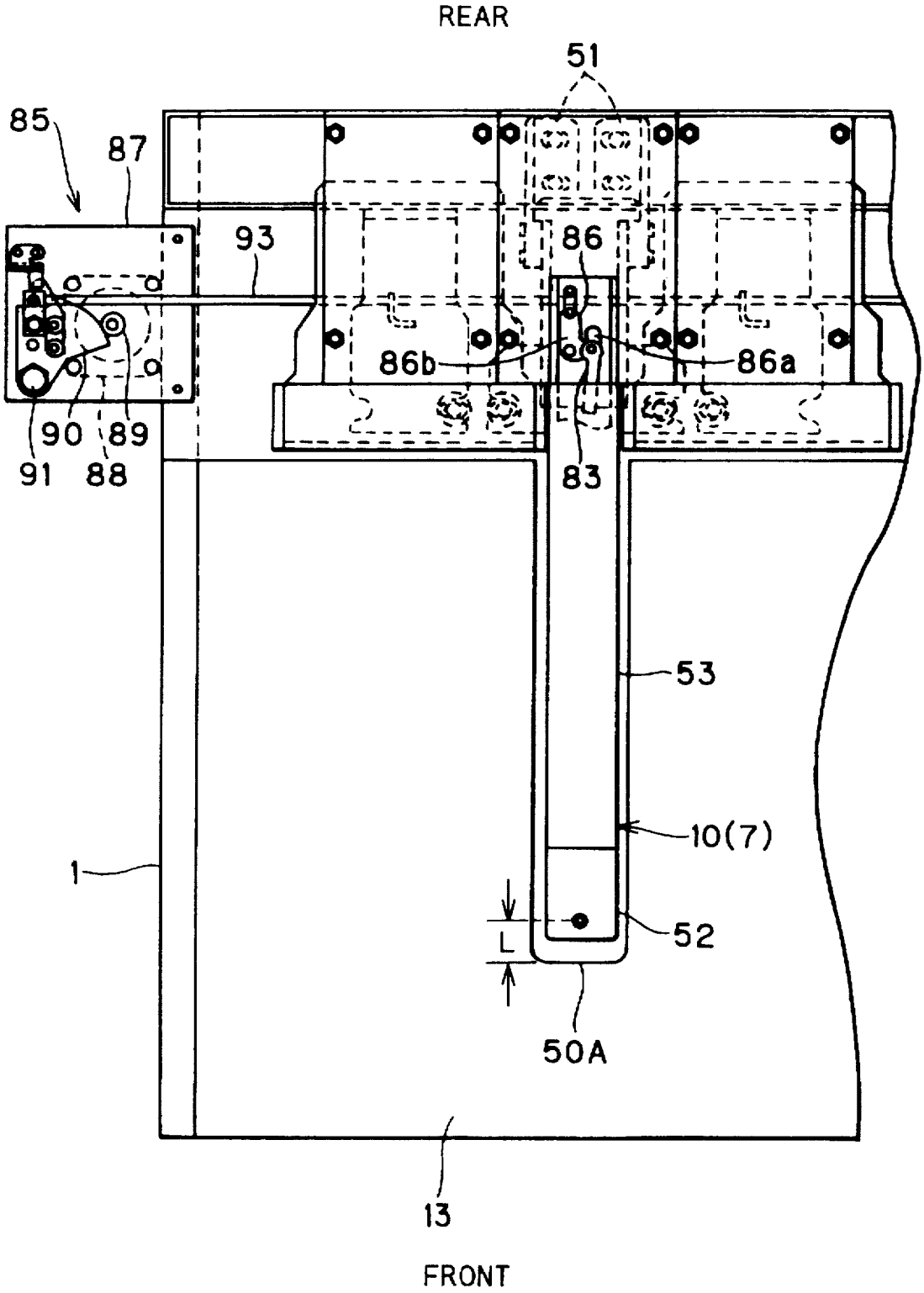
FIG. 3 is a plan view showing an essential portion of a work table and a bed unit according to the embodiment.

A bed case 50 having a substantially U-shape cross-section extends in the frontward/backward direction. The rear end of the bed case 50 is fixed to a pair of support brackets 51 fixedly secured to the base frame 1 extending in the transverse direction. The fixing position of the support brackets 51 to the base frame 1 is located in front of the sewing machine support plate 2. The front portion of the bed case 50 is detachably provided with a rotary hook module 55. As best shown in FIG. 3, the upper front portion of the bed case 50 is covered with the throat plate 52 and the remaining upper side of the bed case 50 is covered with a cover plate 53 provided continuously with the throat plate 52.

Figure 4:
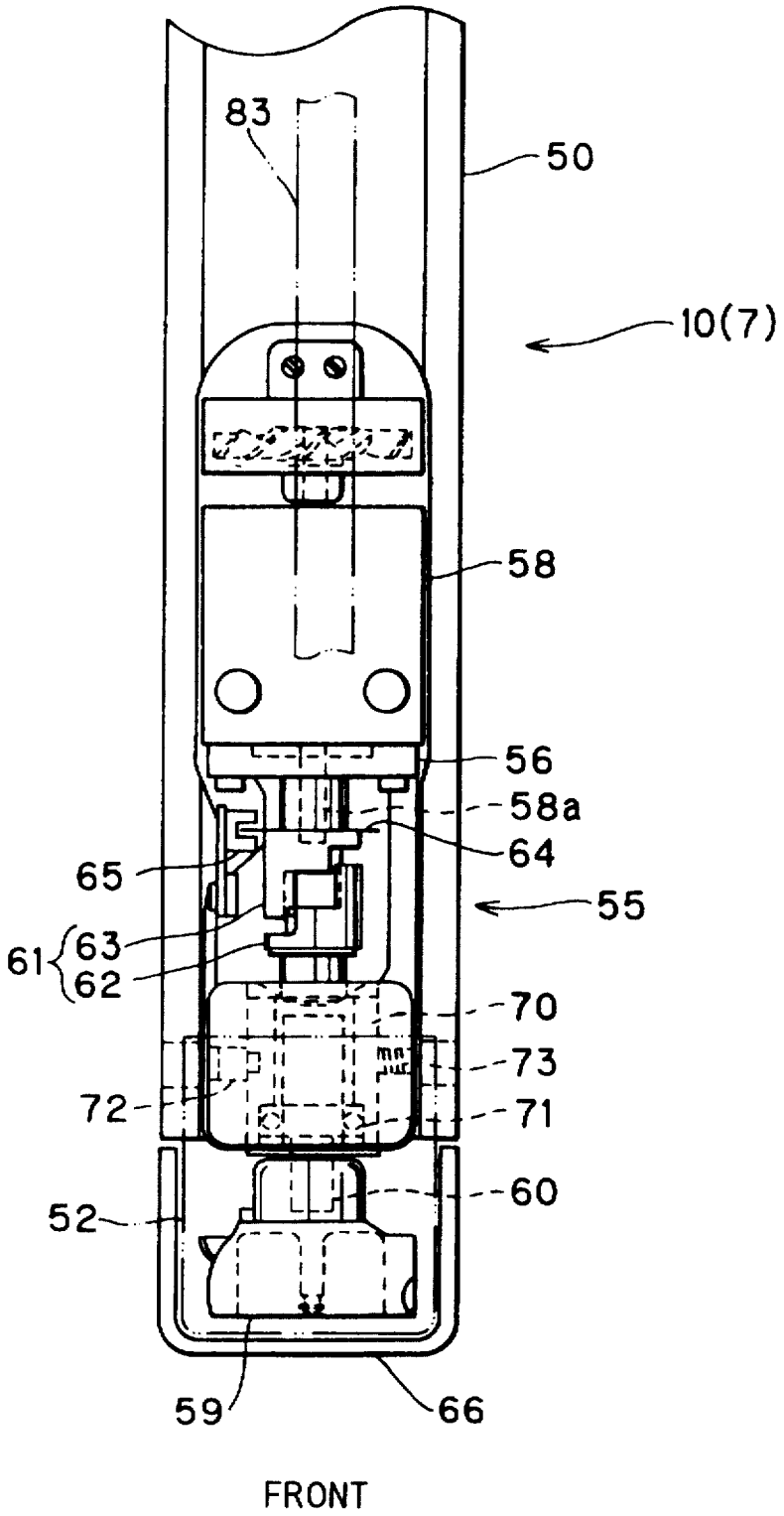
FIG. 4 is a plan view showing a part of the bed unit provided with a rotary hook module according to the embodiment.
Figure 5:
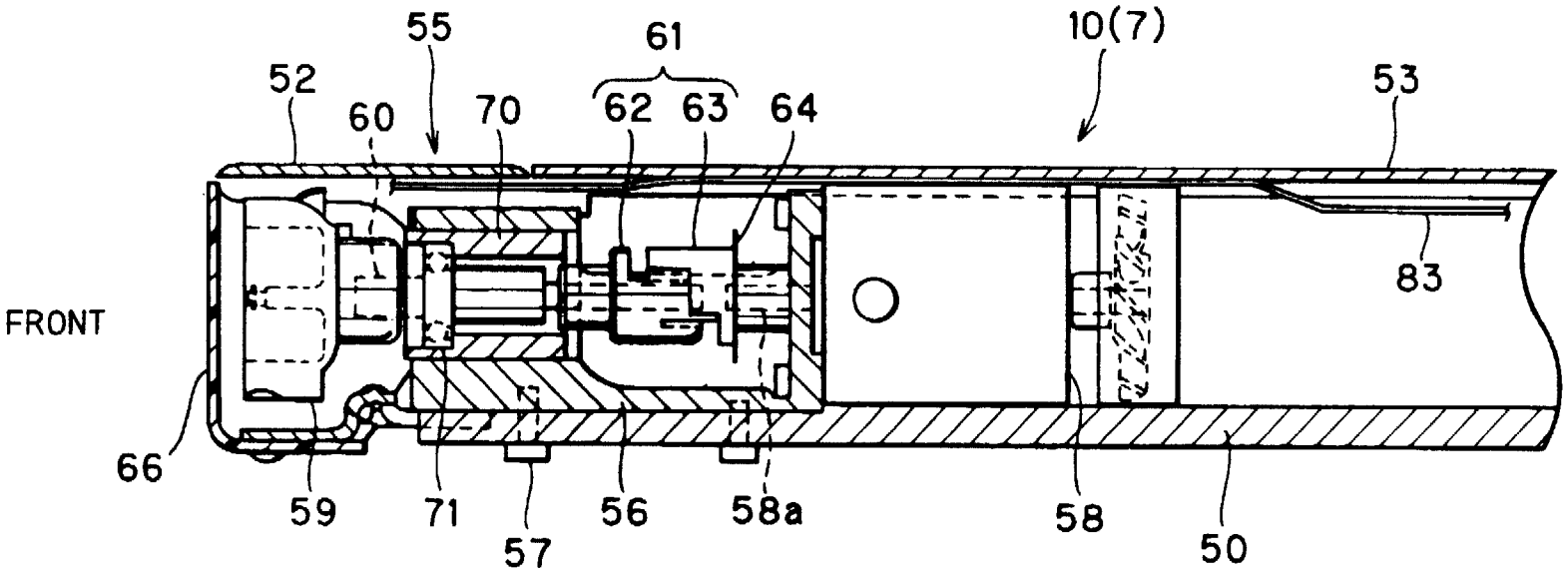
FIG. 5 is a vertical cross-sectional view showing the part of the bed unit provided with the rotary hook module according to the embodiment.

Next, the rotary hook module 55 will be described with reference to FIGS. 4, 5 and 21. An attachment block 56 is detachably fixed to a front end portion of the bed case 50 by screws 57. Further, a rotary hook drive motor 58 such as a stepping motor is attached to a rear end portion of the attachment block 56. The rotary hook drive motor 58 has a drive shaft 58*a*. On the other hand, a rotary hook or a loop taker 59 for trapping a thread loop is provided at a front end portion of the attachment block 56. The rotary hook 59 includes a hook shaft 60 movably frontwardly/backwardly and rotatably supported by the attachment block 56. The hook shaft 60 has a rear end portion fixed with a first coupling member 62. The drive shaft 58*a* of the drive motor 58 has a front end portion fixed with a second coupling member 63. The first and second coupling members 62 and 63 are coupled together, to provide a coupling 61. Thus, the hook shaft 60 and the drive shaft 58*a* are coupled together by the coupling 61.

Figure 21:
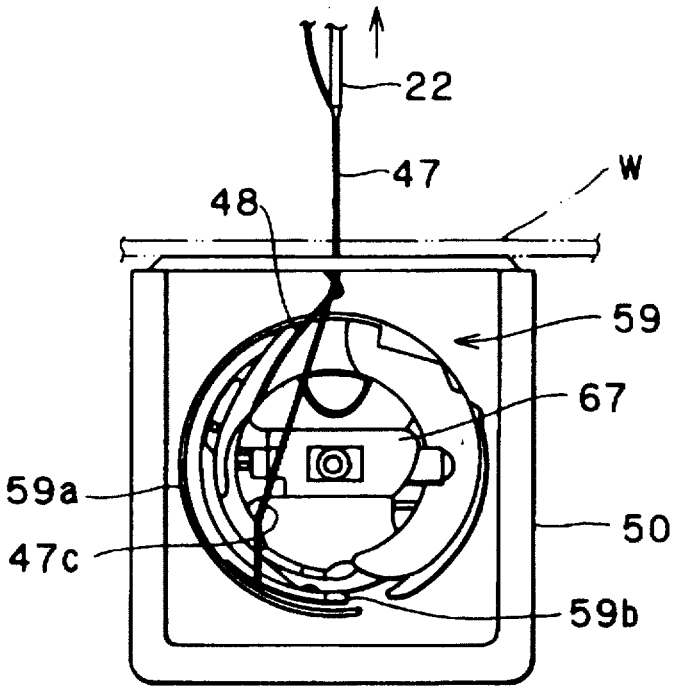
FIG. 21 is a front view showing the rotary hook temporarily stopped when the spindle is at a rotation angle of about 280° according to the embodiment.

The rotary hook 59 is best shown in FIG. 21. The rotary hook 59 includes an inner rotary hook or a bobbin case carrier element accommodating therein a bobbin case 67 in which a bobbin is accommodated, and an outer rotary hook or a hook body 59*a* rotatable around the inner rotary hook. The outer rotary hook 59*a* has a loop seizing beak 59*b* for hooking a needle thread 47 and forming the needle thread loop 47*c*. A needle and rotary hook timing (FIG. 19) is defined when the loop seizing beak 59b intersects the thread hole or eyelet of the sewing needle 22 when the spindle 17 is rotated about 200°. At the needle and rotary hook timing, the loop seizing beak 59b hooks the needle thread 47 extending through the thread hole of the needle 22, and forms the loop 47c moving between the inner rotary hook and the outer rotary hook 59a upon rotation of the outer rotary hook 59a. A bifurcated thread guide portion 59c (FIG. 23) is provided at a position in confrontation with the loop seizing beak 59b.

Further, the second coupling member 63 is provided with a disc encoder 64 formed with a plurality of slits. A second encoder sensor 65 such as a photosensor is attached to the attachment block 56 for optically detecting the plurality of slits and generating a hook shaft rotation signal. Upon rotation of the rotary hook drive motor 58, the hook shaft 60 is rotated through the drive shaft 58a and the coupling 61, so that the rotary hook 59 is rotated in a predetermined direction at a rotation speed K twice as high as a rotation speed of the spindle 17. A protection cover 66 is provided at the front end of the bed unit 10. The protection cover 66 is pivotally connected to the front lower end of the bed case 50, so that the protection cover 66 can be opened or closed. As shown in FIG. 3, a distance L between a needle hole of the throat plate 52 and a front end face 50A of the bed case 50, that is, a front surface of the protection cover 66, can be reduced, because a conventional needle thread trapping member is not provided between the rotary hook 59 and the protection cover 66 as shown in FIG. 5.

Next, a supporting arrangement for position changeably supporting the rotary hook 59 in the frontward/backward direction will be described. The attachment block 56 has a cylindrical portion in which a cylindrical bearing case 70 is disposed slidably in frontward/backward direction. A bearing 71 is force-fitted within the bearing case 70. The attachment block 56 has a left side wall to which an eccentric pin 72 is attached. The bearing case 70 has a left side wall formed with a vertically elongated pin slot, and a pin portion of the eccentric pin 72 is engaged with the pin slot. On the other hand, the attachment block 56 has a right side wall in which a set screw 73 is detachably provided for fixing the bearing case 70 to the attachment block 56.

With this arrangement, after the set screw 73 is unfastened, the eccentric pin 72 is rotated in one or opposite direction, so that the bearing case 70 is moved frontwardly or rearwardly by a minute distance, for example from 1 to 2 mm, because of the engagement between the eccentric pin 72 and the pin slot. Thus, position of the rotary hook 59 is finely controlled in the frontward or rearward direction for controlling a needle and rotary hook clearance.

Next, a thread cutting mechanism 80 will be described with reference to FIGS. 3 through 6. This mechanism is provided in each of the bed units 10, 11, 12 for cutting the needle thread 47 and a bobbin thread 48.

A fixed plate (not shown) is fixed to the attachment block 56, and extends above the rotary hook 59. A movable blade 81 is movably supported to the fixed plate. The movable blade 81 is pivotable between a stand-by position shown by a solid line in FIG. 6 and a maximum pivot position shown by a two dotted chain line. The movable blade 81 has an engaging portion 81a. A stationary blade 82 is provided below the throat plate 52 positioned immediately above the fixed plate. The stationary blade 82 has a blade edge orienting frontwardly for cutting the needle thread 47 and bobbin thread 48 in cooperation with the movable blade 81. The stationary blade 81 has a lower surface provided with a thread holding portion (not shown) for holding an end portion of the cut bobbin thread 48.

A thread cutting operation lever 83 is pivotally connected to the movable blade 81 and extends rearwardly in the bed case 50. That is, upon frontward movement of the thread cutting operation lever 83, the movable blade 81 is pivotally moved in a clockwise direction in FIG. 6 to the maximum pivot position indicated by the two dotted chain line. Then, the thread cutting operation lever 83 is moved rearwardly, so that the movable blade 81 is pivotally moved in a counter-clockwise direction. During this counter-clockwise movement, the needle thread 47 and the bobbin thread 48 are trapped by the engaging portion 81a of the movable blade 81, whereupon the threads 47 and 48 are cut simultaneously by the movable and stationary blades 81 and 82.

Figure 7:
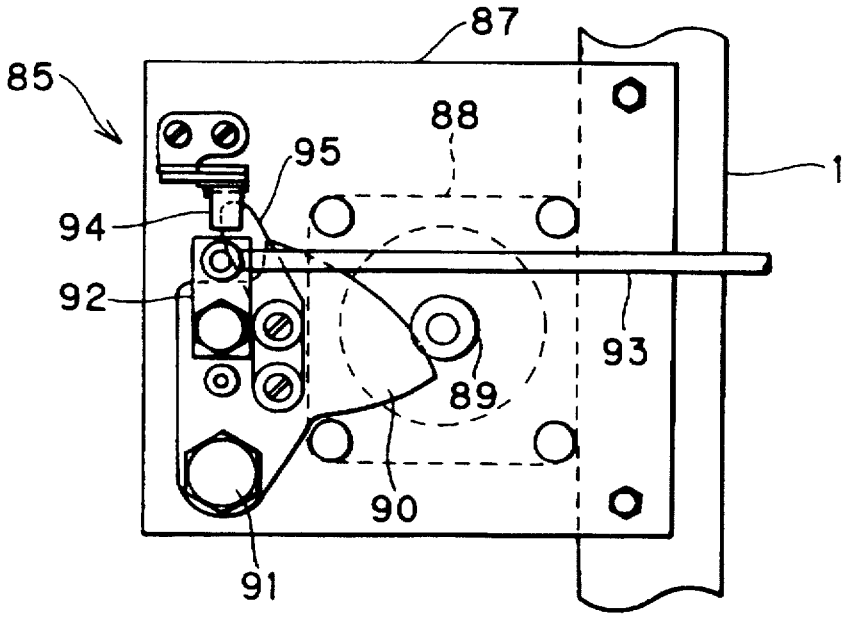
FIG. 7 is an enlarged plan view showing a thread cut driving mechanism according to the embodiment.

A thread cutting driving mechanism 85 for driving the thread cutting mechanism 80 will next be described with reference to FIGS. 3 and 7. A pivot lever 86 having an L-shape configuration in plan view is supported pivotally movably in a horizontal plane on a rear end portion of the bed case 50. The pivot lever 86 has a driven portion 86a to which a rear end of the thread cut operation lever 83 is pivotally connected. At the left end portion of the base frame 1, an attachment plate 87 is fixed, and a thread cutting motor 88 having a drive gear 89 is fixed to a bottom surface of the attachment plate 87. Further, a sector gear 90 meshingly engageable with the drive gear 89 is pivotally movably supported to the attachment plate 87 by a stepped bolt 91. To the sector gear 90, a base end portion of a plate like linking plate 92 is fixed whose tip end portion is linked with a left end portion of a thread cutting operation shaft 93 extending in the transverse direction of the frame 1. The pivot plate 86 has a drive portion 86b to which the thread cutting operation shaft 93 is connected.

Figure 6:
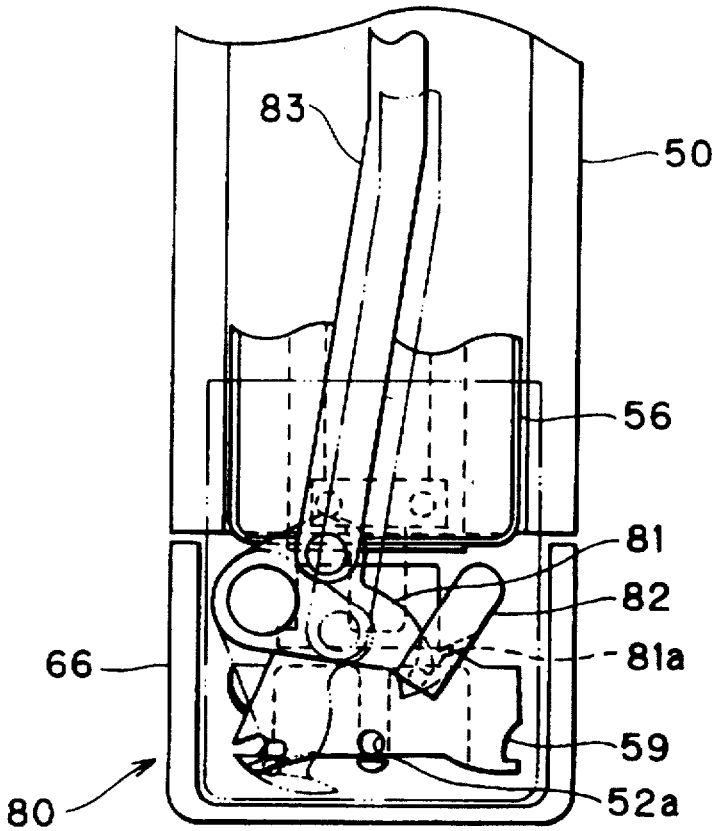
FIG. 6 is an enlarged plan view showing a front portion of the bed unit according to the embodiment.

If the thread cutting motor 88 is rotated in the counter-clockwise direction, the pivot lever 86 is angularly moved a predetermined angle in the clockwise direction, so that the thread cutting operation shaft 93 is moved in its axial direction rightwardly through the linking plate 92. Accordingly, the pivot lever 86 is pivotally moved in the clockwise direction to move the thread cut operation lever 83 frontwardly. Consequently, the movable blade 81 is moved to its maximum pivot position (FIG. 6).

Then, the thread cutting motor 88 is rotated in the clockwise direction to move the thread cut operation shaft 93 leftwardly, so that the pivot plate 86 is pivotally moved in the counterclockwise direction for moving the thread cut operation lever 83 rearwardly. Consequently, the needle thread 47 and the bobbin thread 48 which have been engaged with the movable blade 81 are cut simultaneously in cooperation with the stationary blade 82 as described above.

The attachment plate 87 is provided with a moving position detecting sensor 94 such as a photosensor at a position adjacent to the sector gear 90. Further, the sector gear 90 is provided with a shield plate 95 for shielding the position detecting sensor 94 to render the latter ON. That is, if the movable blade 81 is moved to a position outside of its cutting position, the moving position detection sensor 94 does not detect the shield plate 95, so that the sensor 94 generates "L" level moving position detection signal DS. On the other hand, if the movable blade 81 restores its cutting position, the shield plate 95 is aligned with the sensor 94, so that the sensor 94 generates "H" level moving position detection signal DS.

A control system for the multiple head type embroidery machine M will next be described with reference to a block diagram shown in FIG. 8. A first control device 100 and a second control device 150 are provided. The first control device or a sewing machine control device 100 is adapted for controlling the entire embroidery machine M except the control to the driving mode of the rotary hook 59.

The sewing machine control device 100 is provided with a microcomputer including a CPU 101, a ROM 102 and a RAM 103, and input and output interfaces (not shown) connected to the microcomputer through a data bus. To the sewing machine control device 100, are connected, with respect to the head portion 4, a driver circuit 105 connected to the needle bar jumping solenoid 41, a driver circuit 107 connected to a pressure foot driving solenoid 106, and a thread cutting sensor 108. The same is true with respect to the other head portions 5 and 6.

A driver circuit 111 connected to the sewing machine motor 110 is connected to the sewing machine control device 100. The sewing machine motor 110 has a disc encoder. A first encoder sensor 112 is also connected to the sewing machine control device 100. The first encoder sensor 112 generates a thousand slit signals or spindle rotation signals upon a single rotation of the disc encoder. A point of origin sensor 113 is also connected to the sewing machine control device 100 for generating a single signal indicative of a point of origin of the spindle 17 upon a single rotation of the first encoder sensor 112. A stop position sensor 114 is connected to the control device 100 for detecting a stop position of the needle bar 21, i. e., rotation angle of 100° of the spindle 17. A driver circuit 116 connected to a needle bar changing motor 115 is connected to the control device 100 for moving the needle bar case 20 and changing the needle bar 21 with another needle bar (see FIG. 2). Further, to the sewing machine control device 100, are connected a driver circuit 118 connected to the X-axis drive motor 117, a driver circuit 120 connected to the Y-axis drive motor 119, and the operation panel 18 provided with the display 18*a* and various switches (not shown) for starting stitching operation and inputting various command signals.

The second control device or hook shaft driving control device 150 is connected to the sewing machine control device 100 for controlling the rotary hook 59 and thread cutting operation. The hook shaft driving control device 150 is provided with a microcomputer including a CPU 151, a ROM 152 and a RAM 153, and input and output interfaces (not shown) connected to the microcomputer through data bus. Regarding the bed unit 10, the rotary hook drive motor 58 (FIG. 4) is connected to the control device 150 through a driver circuit 154, and a second encoder sensor 65 (also shown in FIG. 4) and a hook shaft point of origin sensor 155 are also connected to the control device 150. The second encoder sensor 65 is adapted to generate fifty slit signals (hook shaft rotation signal) upon a single rotation of the disc encoder 64 (FIG. 4) connected to the rotary hook drive motor 58. The point of origin sensor 155 is adapted to generate a single synchronization signal of the hook shaft upon a single rotation of the disc encoder 64. A counter 156 is connected to the control device 150 for providing a count value "T" indicative of a drive step number of the rotary hook drive motor 58. The other bed units 11, 12 also provide the control system identical with the above described arrangement. Further, the moving position detection sensor 94 and a driver circuit 156 connected to the thread cutting motor 88 (FIGS. 3 and 7) are connected to the hook shaft control device 150.

An induction motor is available as the sewing machine motor 110 which is subjected to an inverter control. The 1000 slit signals (spindle rotation signals) transmitted from the first encoder sensor 112 by the single rotation of the disc encoder provided to the sewing machine motor 110 are subdivided into 4000 pulses which are used as the spindle control pulses for controlling the motor. On the other hand, a stepping motor is available as the rotary hook drive motor 58, and is rotated by 360° upon receipt of 500 pulses, and simultaneously, the rotary hook 59 is also rotated by 360°. The rotary hook drive motor 58 is subjected to velocity doubling control at a rotation speed "K" in such a manner that the rotary hook drive motor 58 is rotated twice during single rotation of the spindle 17.

The ROM 152 stores therein a synchronous drive position data concerning allowable numbers of driving pulses of the rotary hook drive motor 58 corresponding to each rotational position of the spindle 17. That is, the relationship between the allowable range of the driving pulses and each rotational position of the spindle 17 is stored in a table-like fashion.

A routine executed by the hook shaft control device 150 for controlling the hook shaft will next be described with reference to flowcharts shown in FIGS. 9 through 15. First, reference is made on signals transmitted from the sewing machine control device 100 to the hook shaft control device 150 with reference to FIG. 18. At the start up timing of the stitching, the spindle 17 is stopped at its rotation angle of about 100°, and the needle bar 21 is stopped at its uppermost position by the needle bar jumping mechanism 40.

If embroidery stitching is to be performed in accordance with embroidery sewing data which includes needle location data including N number of stitch, an "H" level spindle drive signal from the sewing machine control device 100 is provided, and rotation of the sewing machine motor 110 is started. Here, the embroidery stitching data include not only thread cutting data for performing thread cutting operation at a final Nth number of stitch, but also needle thread cutting data for performing the needle thread cutting operation when changing the needle thread with another needle thread. Therefore, embroidery sewing is consecutively performed by N number of stitch, and the needle thread cutting operation is carried out at the middle of the embroidery stitching.

Figure 19:
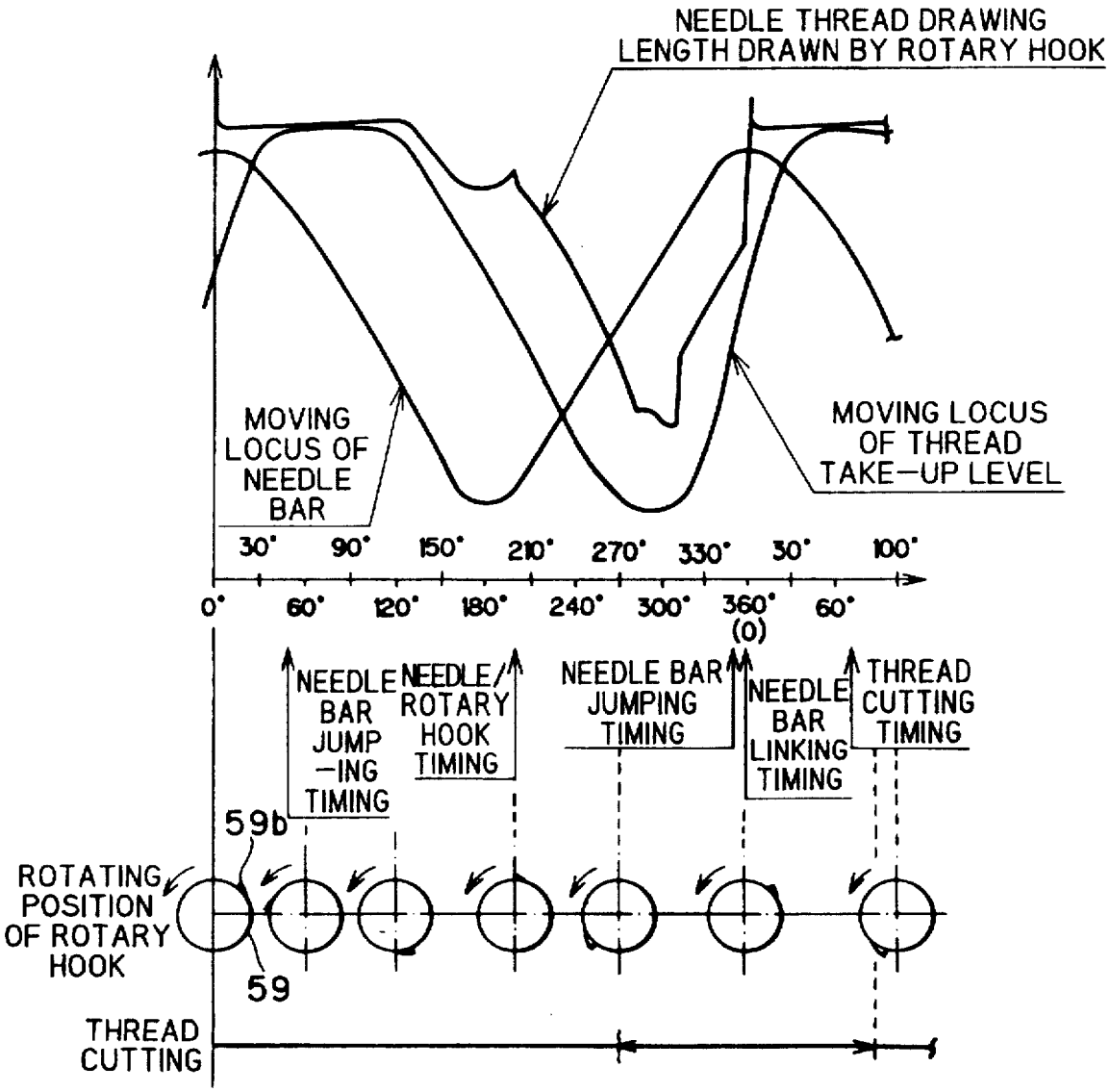
FIG. 19 is a view for description of moving loci of a needle bar and a thread take-up lever, needle thread drawing length drawn by the rotary hook, and rotating position of a rotary hook in connection with a rotating position of the spindle according to the embodiment.

FIG. 19 shows moving loci of the needle bar and the thread take-up lever, needle thread drawing length drawn by the rotary hook, and rotating position of the rotary hook 59 in accordance with the rotation angle of the spindle 17. Here, the rotating position of the rotary hook 59 is indicated by the angular position of the loop seizing beak 59*b*.

At the first number of stitch, the needle bar 21 is automatically linked to the vertically movable segment 27 when the rotation angle of the spindle 17 is 0°, i.e., when the needle bar 21 is at its uppermost position. Therefore, actual stitching is started at the second number of stitch if the picker operation, i.e., operation for drawing the residual end portion of the needle thread 47 toward the back side of the workpiece fabric, is not performed at the stitch starting phase. At the final Nth number of stitch, the spindle drive signal is changed to the "L" level when the spindle rotation angle is about 260°, and thread cutting signal is outputted. Then, the thread cutting operation is performed while the spindle rotation angle is in a range of from 270° to 448° (88°). Immediately after the thread cutting operation, rotation of the spindle is stopped when the spindle is rotated to 460° (100°).

Figure 9:
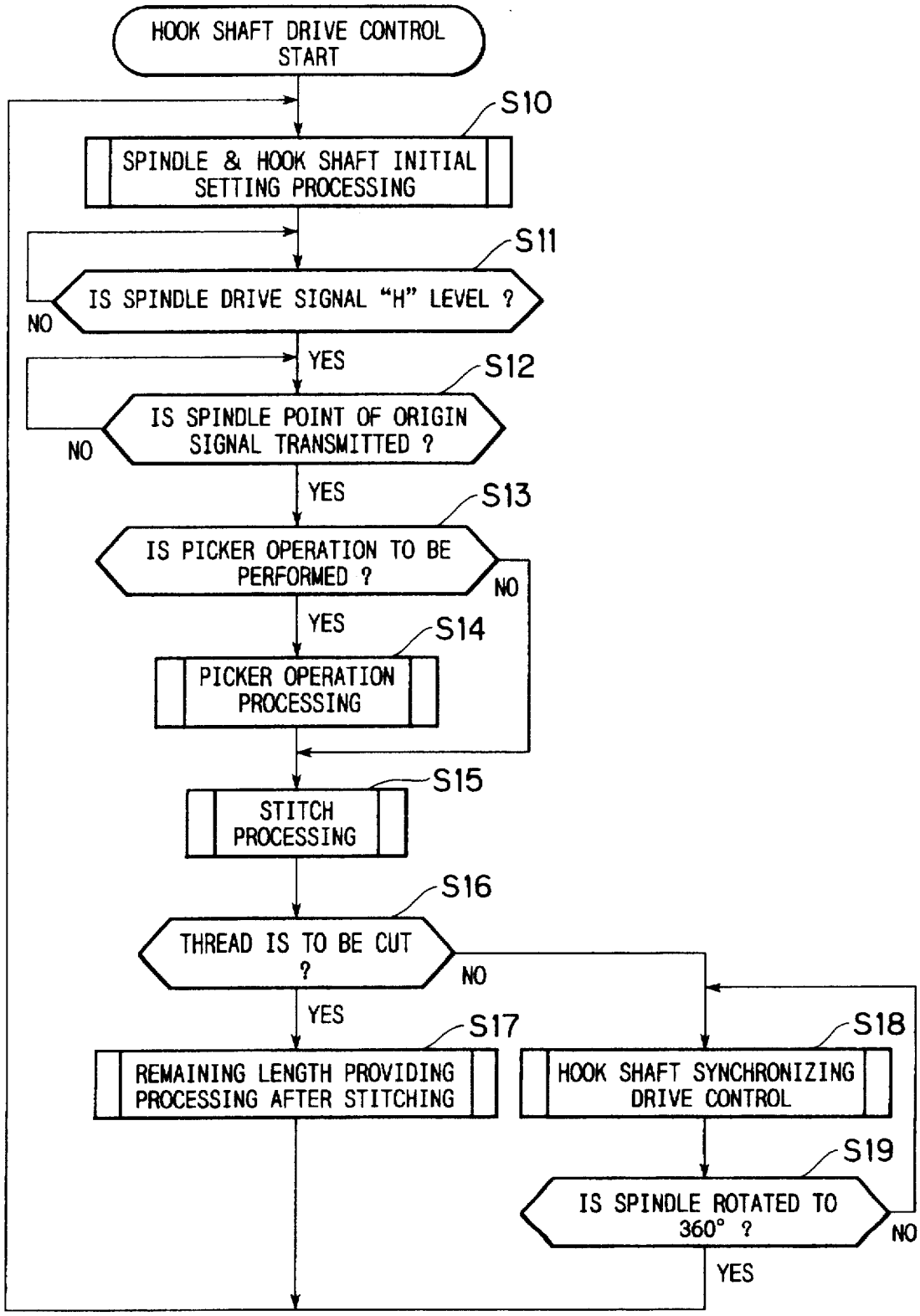
FIG. 9 is a flowchart showing a hook shaft drive control routine according to the embodiment.

If electrical power is supplied to the multiple head type embroidery machine M, the hook shaft driving control is started, and as shown in FIG. 9, initial setting process with respect to the spindle and the hook shaft will be executed in step S10.

Figure 10:
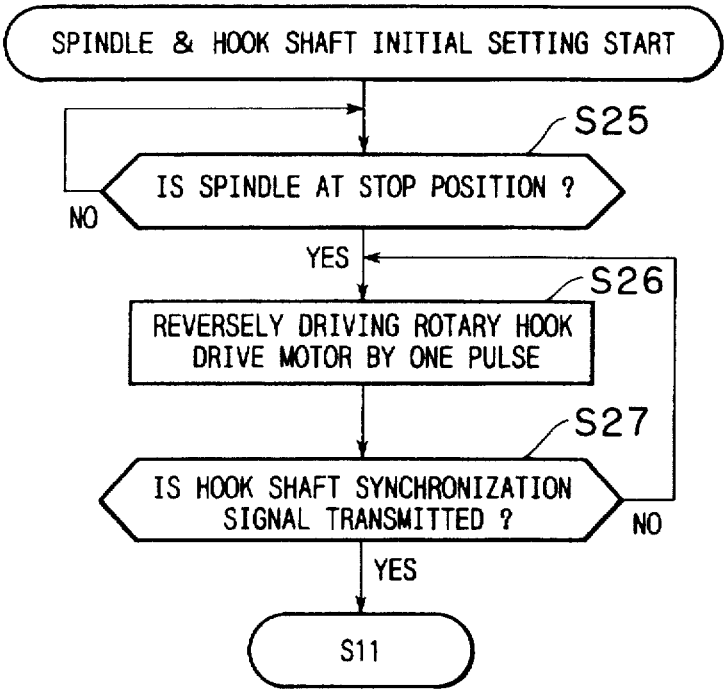
FIG. 10 is a flowchart showing a spindle and hook shaft initial setting routine according to the embodiment.
Figure 20:
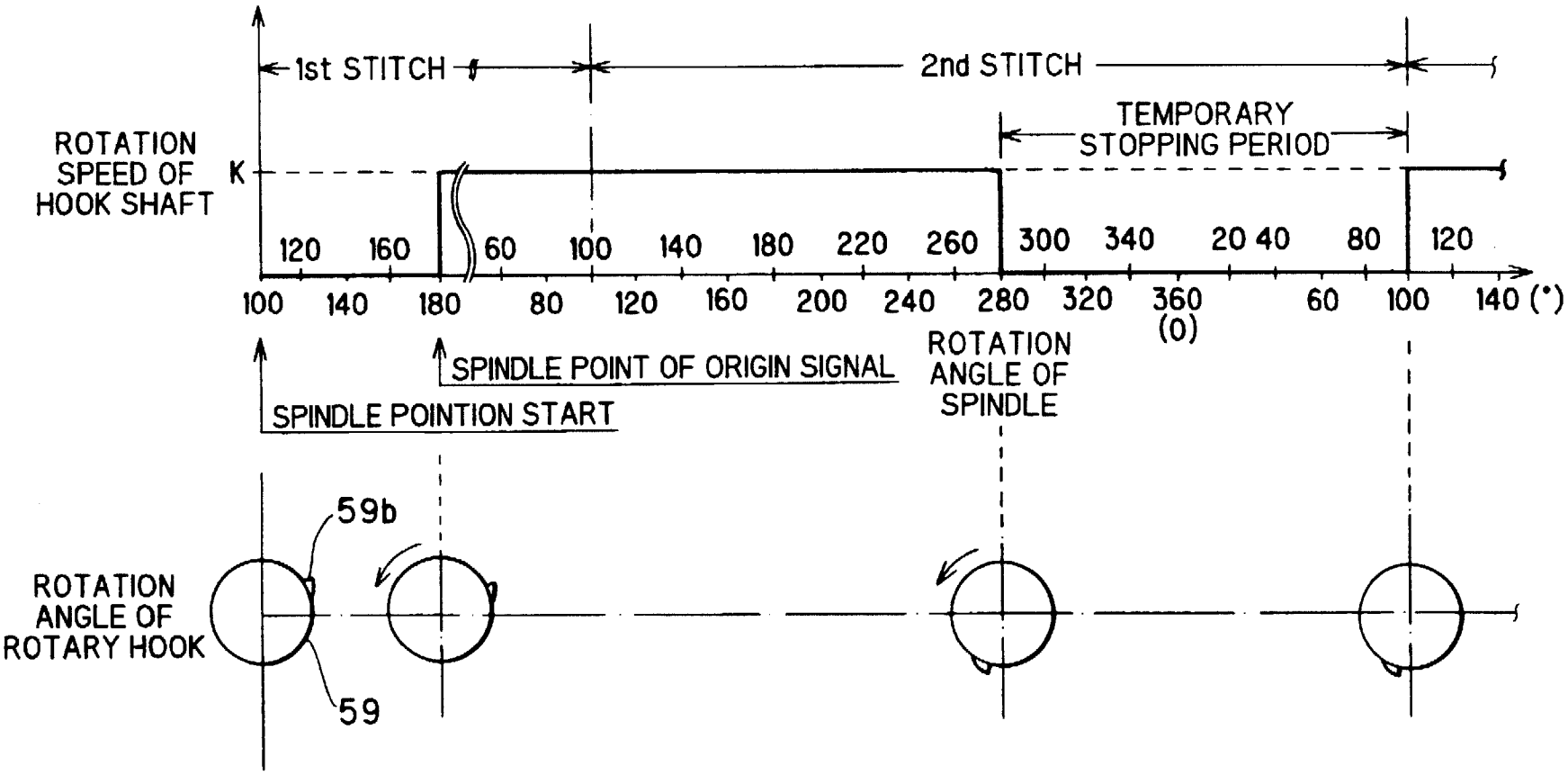
FIG. 20 is a graphical representation showing the relationship between the rotation speed of a hook shaft and the rotating position of the spindle at a stitch starting period according to the embodiment.

In the initial setting process shown in FIG. 10, firstly, judgment is made as to whether or not the spindle 17 is positioned in its stop position in S25. That is, the stop position signal from the stop position sensor 114 is retrieved. If the spindle 17 is positioned at its stop position, i.e., the precedent stitching process is completed and thread cutting operation has finished, the spindle 17 is at its initial setting position where angular position of the spindle 17 is normally about 100 . If the spindle 17 is at its stop position (S25:Yes), the hook shaft 60 is at its rotating angle position corresponding to the rotating angle position of 13 of the spindle 17. Therefore, the rotary hook drive motor 58 is reversely driven by 1 pulse (S26) so as to return the rotational position of the hook shaft 60 to a rotating position at which the hook shaft synchronization signal is outputted from the hook shaft point of origin sensor 155. If the hook shaft synchronization signal is not outputted from the hook shaft point of origin sensor 155 (S27:No), the routines S26 and S27 are repeatedly executed. On the other hand, if the hook shaft 60 is rotated to its initial setting position corresponding to the rotation start position (180°) of the spindle 17 (S27:Yes) as shown in FIG. 20, the initial setting routine is ended, and the routine returns to step S11 (FIG. 9) of the hook shaft drive control routine.

If the spindle 17 is not at its stop position, (S25:No), an error message notifying the operator of this fact is displayed on the display 18*a*. Therefore, an operator manually rotates the spindle for setting its rotational stop position.

Then, in the hook shaft driving control routine, if the "H" level spindle drive signal has not yet been outputted from the sewing machine control device 100, that is, stitching operation has not yet been started (S11: No), the step S11 is repeatedly executed until stitching is started.

Figure 18:
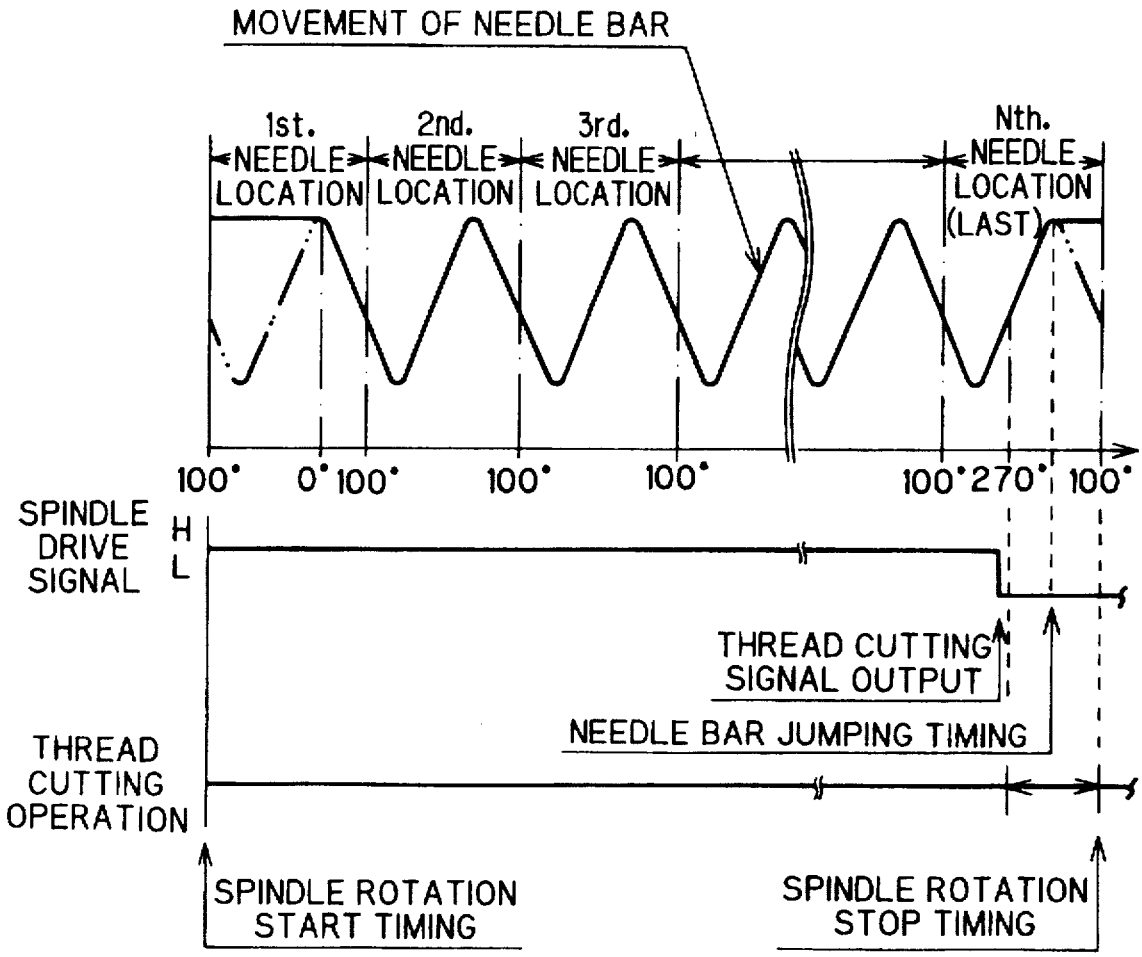
FIG. 18 is a time chart showing the relationship between the various signals and rotation angles of a spindle in accordance with embroidery sewing data for Nth number of stitch according to the embodiment.

At the time of the start of the stitching, if "H" level spindle drive signal is transmitted from the sewing machine control device 100 (S11: Yes), the sewing machine motor 110 is simultaneously energized, and the spindle 17 is driven from its rotational position of 100° as shown in FIG. 18.

Then, as shown in FIG. 20, in the first number of stitch, if the spindle 17 is rotated to 170° so that the spindle point of origin sensor 113 generates a spindle point of origin signal (S12: Yes), judgment is made as to whether or not the picker operation with respect to the needle thread is to be performed in S13. If the judgment falls Yes, the picker operation process will be executed in S14.

Figure 11:
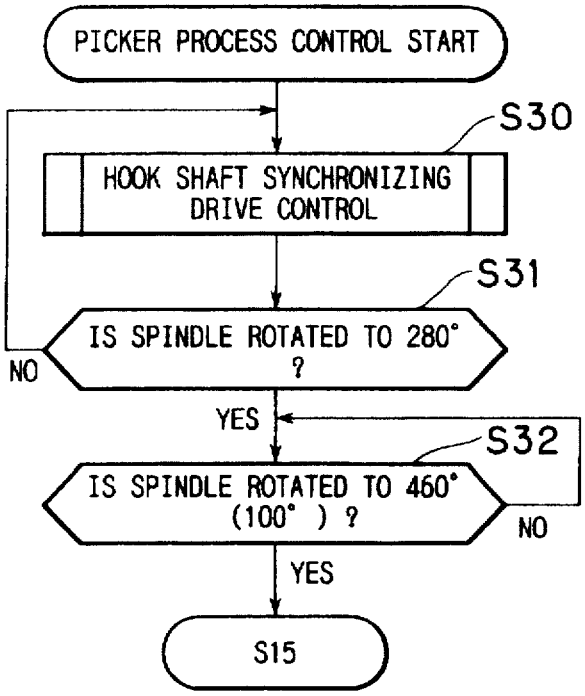
FIG. 11 is a flowchart showing a picker process control routine according to the embodiment.
Figure 12:
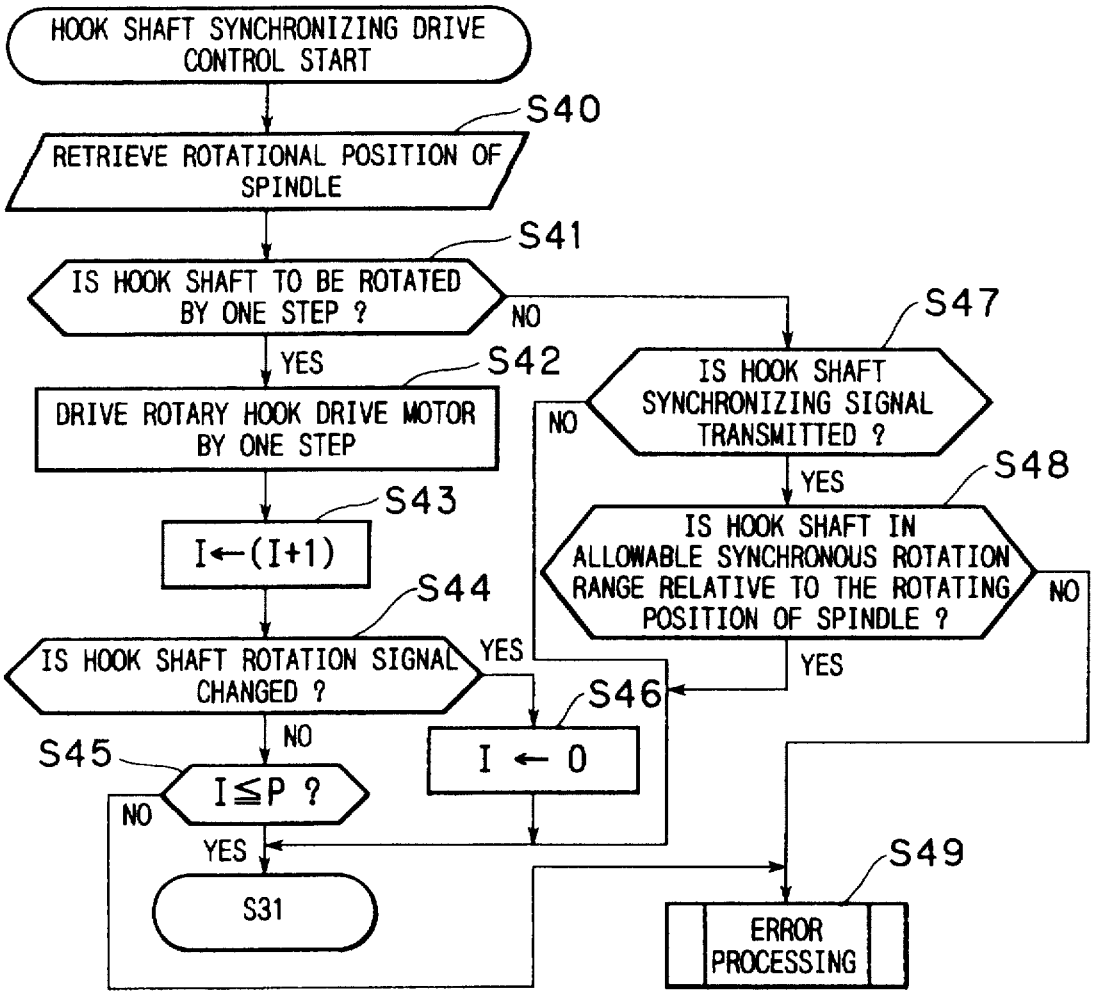
FIG. 12 is a flowchart showing a hook shaft synchronizing drive control routine according to the embodiment.

In the picker operation process as shown in FIG. 11, the hook shaft synchronizing drive control is first executed in S30, and this control is shown in a flowchart of FIG. 12. In S40, rotational position of the spindle 17 is retrieved by cumulatively counting the spindle rotation signals transmitted from the first encoder sensor 112. If the hook shaft 60 is about to be driven by one step (S41: Yes) in order to obtain synchronous rotation of the hook shaft with the spindle 17, the hook shaft drive motor 58 is driven by one step (S42).

Then, in order to acknowledge the rotation of the hook shaft 60, a drive step number of the rotary hook drive motor 58 is counted by the counter 156, and the count value "T" is incremented by one (S43). If the count value "T" is not more than a predetermined count value "P", for example, the count value "T" is in a range of 10 to 15 (S45:Yes) while the hook shaft rotation signal transmitted from the second encoder sensor 65 is not changed (S44:No), the routine is ended and returned back to a step S31 of the picker operation process shown in FIG. 11. On the other hand, if the hook shaft rotation signal is changed (S44:Yes) which means that the hook shaft 60 is actually driven, the routine proceeds into step S46 where the count value "T" is cleared, and the routine is similarly returned to the S31 of the picker operation process.

If the hook shaft synchronization signal from the hook shaft point of origin sensor 155 has not yet been transmitted (S47: No) at a timing other than the driving timing of the hook shaft 60 by one step (S41:No), the routine is also returned to the S31. On the other hand, if the hook shaft synchronization signal is transmitted (S47:Yes), determination is made as to whether or not the hook shaft 60 is rotated within the allowable rotation range relative to the rotation of the spindle 17. That is, as described above, the ROM 152 stores therein the synchronous drive position table containing the relationship between the rotational position of the spindle 17 and the allowable numbers of the driving pulses of the rotary hook drive motor 58. Therefore, based on the rotational position data of the spindle 17 retrieved in S40, driving pulse number of the rotary hook drive motor 58 and the data of the synchronous drive position table stored in the ROM 152, this determination step S48 is executed. If the hook shaft 60 is synchronously driven within the allowable rotation range relative to the rotation of the spindle 17 (S48:Yes), the routine returns back to the step S31.

Figure 15:
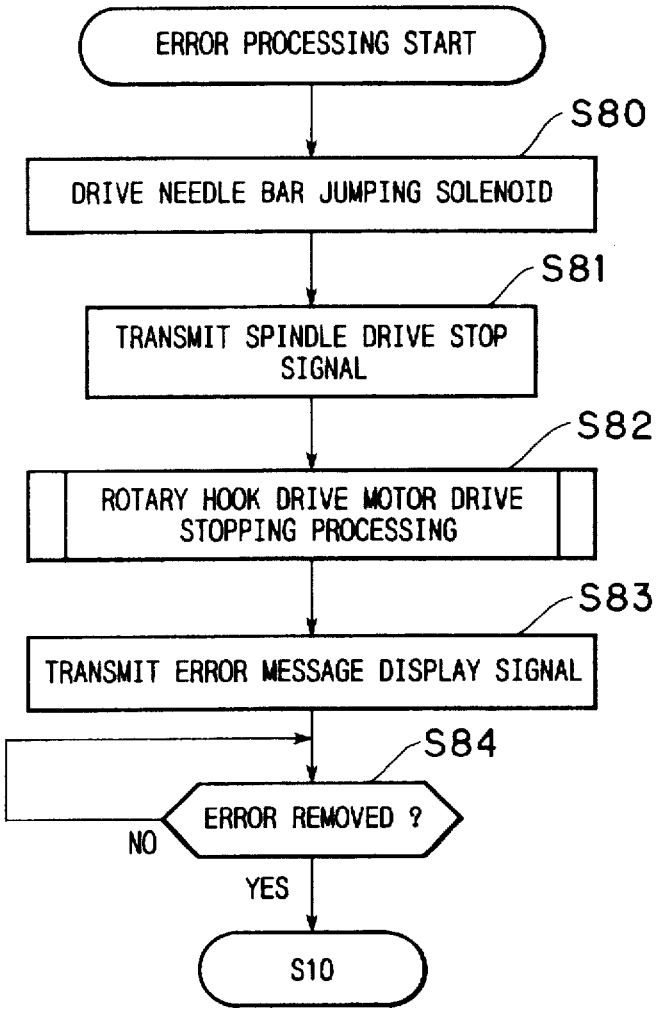
FIG. 15 is a flowchart showing an error processing routine according to the embodiment.

If the count value "T" exceeds the predetermined count value "P" (S45: No), or if the rotation range of the hook shaft 60 is outside of the allowable rotation range relative to the rotation of the spindle 17, i.e., if the hook shaft is not synchronously rotated with the spindle (S48: No), the routine proceeds into step S49 where the error processing shown in FIG. 15 is executed.

In the error processing, the needle bar jumping solenoid 41 is driven for a predetermined period (S80). As a result, the vertically movable segment 27 is pivotally moved to its jumping position, so that the needle bar 21 is promptly jumped to its uppermost position. Consequently, mechanical bump between the needle 22 and the rotary hook 59 is avoidable.

Then, a spindle drive stop signal is transmitted to the sewing machine control device 100 in order to stop rotation of the sewing machine motor 110 (S81). In response to the stop signal, a brake signal is outputted from the sewing machine control device 100 to the driver circuit 111, so that rotation of the sewing machine motor 110 is promptly stopped. At the same time, drive stop processing is also executed (S82) in which a brake signal is transmitted to the driver circuit 154. Therefore, the rotation of the rotary hook drive motor 58 is also stopped. Then, a display signal is transmitted to the sewing machine control device 100 (S83) so as to display an error message on the display 18*a*. The operator can notice the malfunction, and if the malfunction is removed upon manipulation of an error removing switch provided on the operation panel 18 (S84:Yes), this routine is ended, and the routine returns to the spindle and hook shaft initial setting processing S10.

In the picker operation processing, if the spindle 17 has not yet been rotated to 280° (S31:No), the steps S30 and S31 are repeatedly executed. If the spindle 17 is rotated to 280° in the second number of stitch as shown ion FIG. 20 (S31: Yes), the rotation of the rotary hook drive motor 58 is stopped until the spindle 17 is rotated to 460° (100°) (S32: No). Thus, the rotation of the hook shaft 60 is forcibly stopped.

More specifically, during the second number of stitch and the rotation angle of the spindle 17 is in a range of 280° to 460°, the rotary hook 59 is at the rotating positions shown in FIGS. 19 through 21. In this state, the loop seizing beak 59*b* engages the needle thread to form the needle thread loop 47*c*, so that the needle thread is not disengaged from the rotary hook 59. Further, in this state, the workpiece fabric is fed in its feeding direction while the sewing needle 22 and the thread take-up lever 23 are elevated.

In accordance with the ascent movement of the needle 22 and the thread take-up lever 23, the needle thread 47*a* extending from the thread hole of the needle 22 is stretched in the upward direction. That is, tension is applied to the needle thread. In this case, because the residual end portion of the needle thread appearing at the upper surface of the workpiece fabric is imparted with a lesser frictional resistance than that of the other needle thread passing through the thread take-up lever 23, and because the rotation of the rotary hook is stopped, the residual end portion of the needle thread appearing at the upper surface of the workpiece fabric W is pulled toward the rotary hook 59 through the workpiece fabric W and a needle hole 52*a* of the throat plate 52. Accordingly, the needle thread loop 47*c* substantially disappears. If the spindle 17 is further rotated to 100°, that is, the rotary hook 59 reaches a rotating position in synchronism with the spindle 17 (S32: Yes), the picker operation processing is ended, and the routine goes into S15 where stitch processing will be executed.

Figure 13:
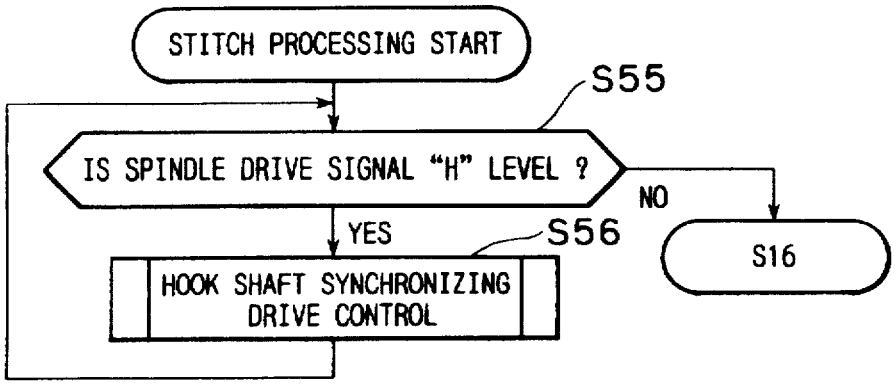
FIG. 13 is a flowchart showing a stitch processing routine according to the embodiment.

In the stitch processing, as shown in FIG. 13, if the stitching operation is continued with the "H" level spindle drive signal (S55: Yes), the above described hook shaft synchronizing drive control processing is repeatedly executed during a period bridging from the third number of stitch to the final Nth number of stitching operation, i.e., until the spindle drive signal becomes "L" level for stopping the stitching process. During this period, stitching operation is performed consecutively (S56). If the stitching reaches the Nth number of stitch, a "L" level spindle drive signal is transmitted (S55:No), the stitch processing is ended, and the routine returns to S16.

In the hook shaft drive control processing, if the thread cutting operation is not performed under the command signal from the sewing machine control device 100 at the final Nth number of stitch (S16: No), the hook shaft synchronizing drive control is executed (S18, S19: No) until the spindle 17 is rotated to 360°. Then the routine returns back to S10 when the spindle 17 is rotated to 360° at which the loop seizing beak 59*b* does not interfere with the sewing needle 22.

On the other hand, if thread cutting is to be performed (S16:Yes), remaining length providing processing for obtaining a certain remaining length of the needle thread extending from the eyelet of the needle will be executed in S17. Here, concurrently with the remaining length providing processing, thread cutting processing will also be started from the state where the spindle 17 is at its rotating position of 270°. The thread cutting processing will be described later.

Figure 14:
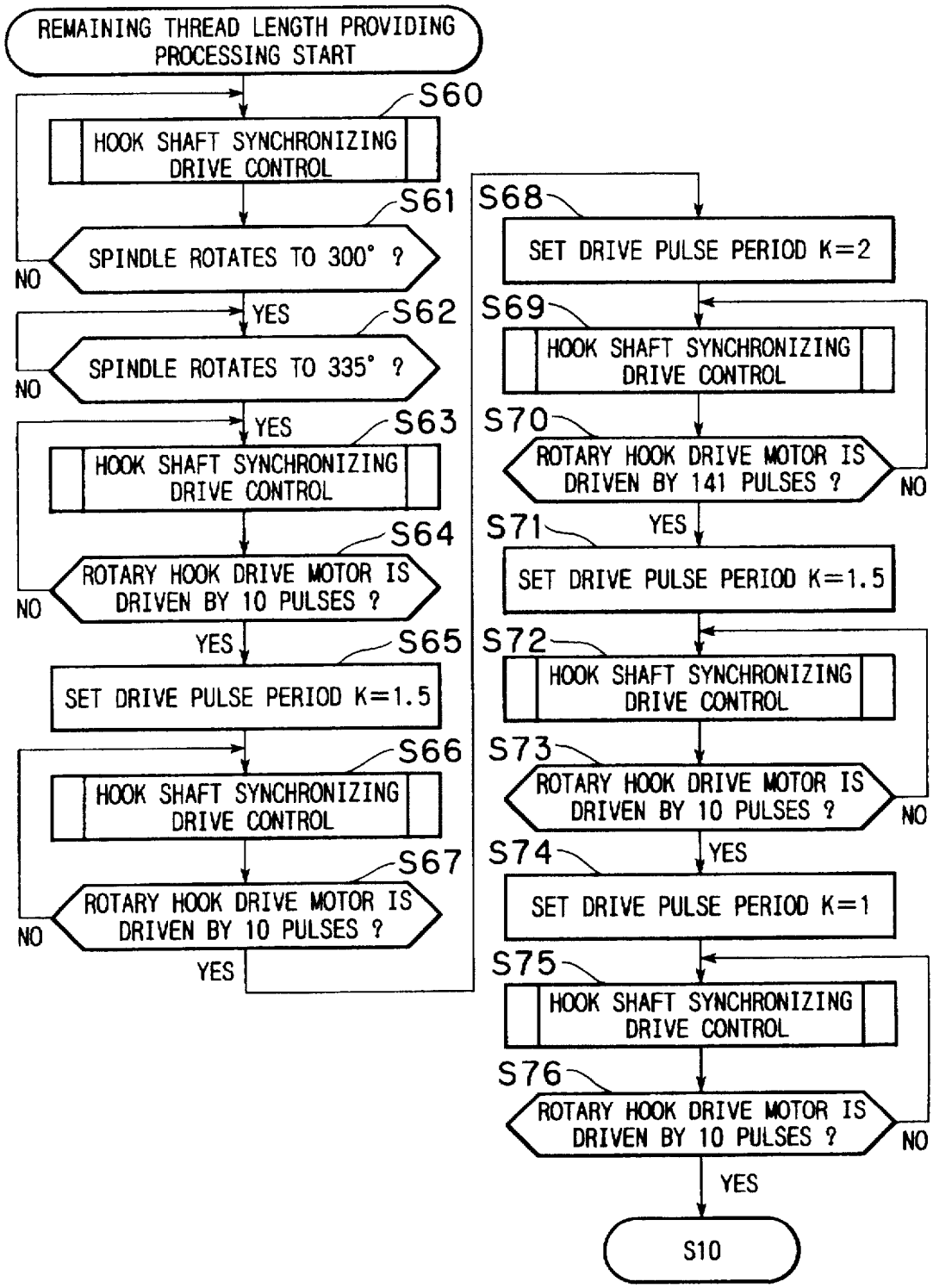
FIG. 14 is a flowchart showing a remaining needle thread length providing processing routine according to the embodiment.
Figure 22:
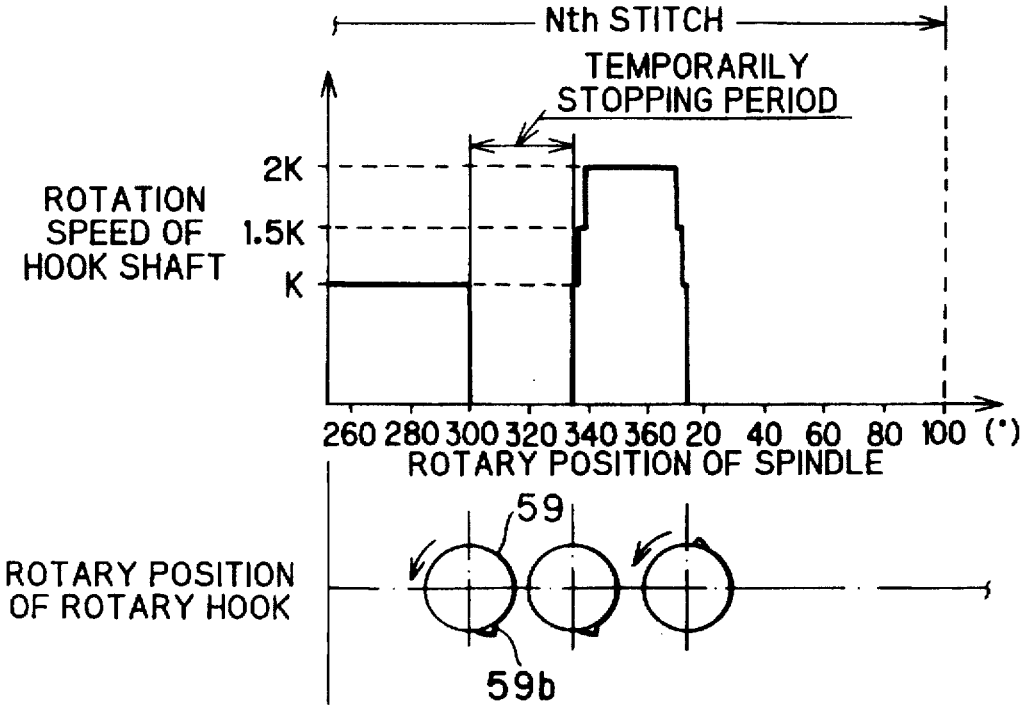
FIG. 22 is a graph showing the relationship between the rotation speed of the rotary hook and the rotation angle of the spindle at the thread cutting operation according to the embodiment.

In the remaining thread length providing processing, as shown in FIG. 22 and FIG. 14, the hook shaft synchronizing drive control is executed (S60, S61: No) in which the hook shaft 60 is rotated at a constant velocity "K" until the spindle 17 reaches its rotating position of 300° during the final Nth number of stitch.

If the spindle 17 rotates to 300° (S61:Yes), the rotation of the rotary hook drive motor 58 is temporarily stopped until the spindle 17 rotates to 335°. During this period, the rotation of the hook shaft 60 is forcibly temporarily stopped (S62: No).

Figure 23:
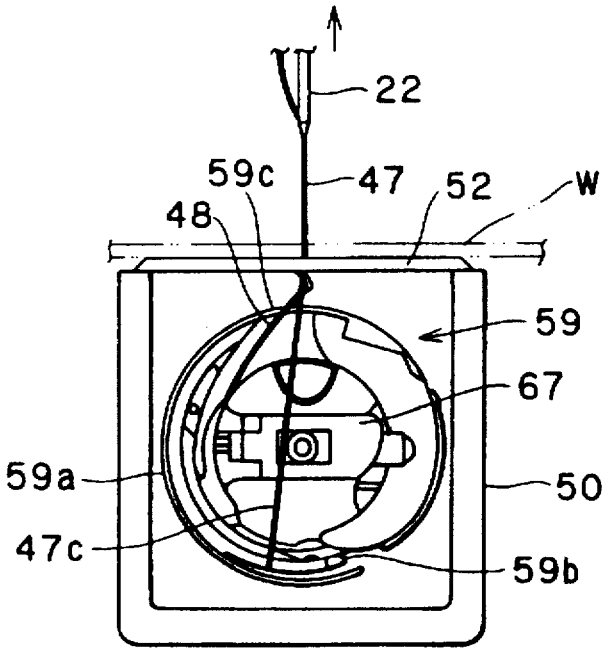
FIG. 23 is a front view showing the rotary hook temporarily stopped when the spindle is at a rotation angle of about 300° according to the embodiment.

That is, during the Nth number of stitch, if the rotation angle of the spindle 17 is in a range of 300° to 335°, the rotary hook 59 is at its rotational position shown in FIGS. 22 and 23. In this state, the needle thread loop 47*c* has a maximum size while maintaining engagement with the rotary hook 59. Further, in this period, the needle 22 and the thread take-up lever 23 are elevated while the feeding of the workpiece fabric is carried out. In this case, since the needle thread 47*a* extending through the eyelet of the needle 22 is already stretched into the workpiece fabric W, and since the rotation of the rotary hook 59 is temporarily stopped, the decreasing length of the needle thread in accordance with the upward movement of the thread take-up lever 23 can be compensated by the needle thread wound around a spool (not shown).

Therefore, when the needle thread is subjected to subsequent cutting operation, sufficient length of the needle thread extending from the eyelet of the needle can be provided, the length corresponding to the length supplied from the spool, and the length being sufficient for preventing the needle thread from being passed through and disengaged from the eyelet of the needle in the subsequent stitch starting phase.

If the spindle 17 is rotated to 335° (S62:Yes), steps S63 through S76 are executed for controlling the rotation of the rotary hook drive motor 58 in such a manner that the rotary hook drive motor 58 is rotated at high speed proportional to the rotation speed of the spindle 17 but not exceeding a self start-up frequency during about 38° rotation period of the spindle 17. With this control, the needle thread 47*c* can be promptly disengaged from the rotary hook 59 for obtaining a stabilized residual length of the needle thread.

More specifically, as shown in FIGS. 14 and 22, the rotary hook drive motor 58 is driven at the predetermined rotation speed K during the initial 10 pulses after the spindle 17 reaches the rotational position of 335° (S66, and S64:Yes). Then, the drive pulse period is set to K=1.5 (S:65), so that the rotary hook drive motor 58 is driven at the rotation speed of 1.5K during a subsequent 10 pulses (S66, S67:Yes). Next, the drive pulse period is set to K=2 (S:68), so that the rotary hook drive motor 58 is driven at the rotation speed of 2K during a subsequent 141 pulses (S69, S70:Yes).

Then, the drive pulse period is set to K=1.5 (S71) so that the rotary hook drive motor 58 is driven at the rotation speed of 1.5K during a subsequent 10 pulses (S72, S73:Yes). Then, the drive pulse period is set to K=1 (S:74), so that the rotary hook drive motor 58 is driven at the rotation speed of K during a subsequent 10 pulses (S75, S76:Yes). Then the routine returns to S10.

Figure 16:
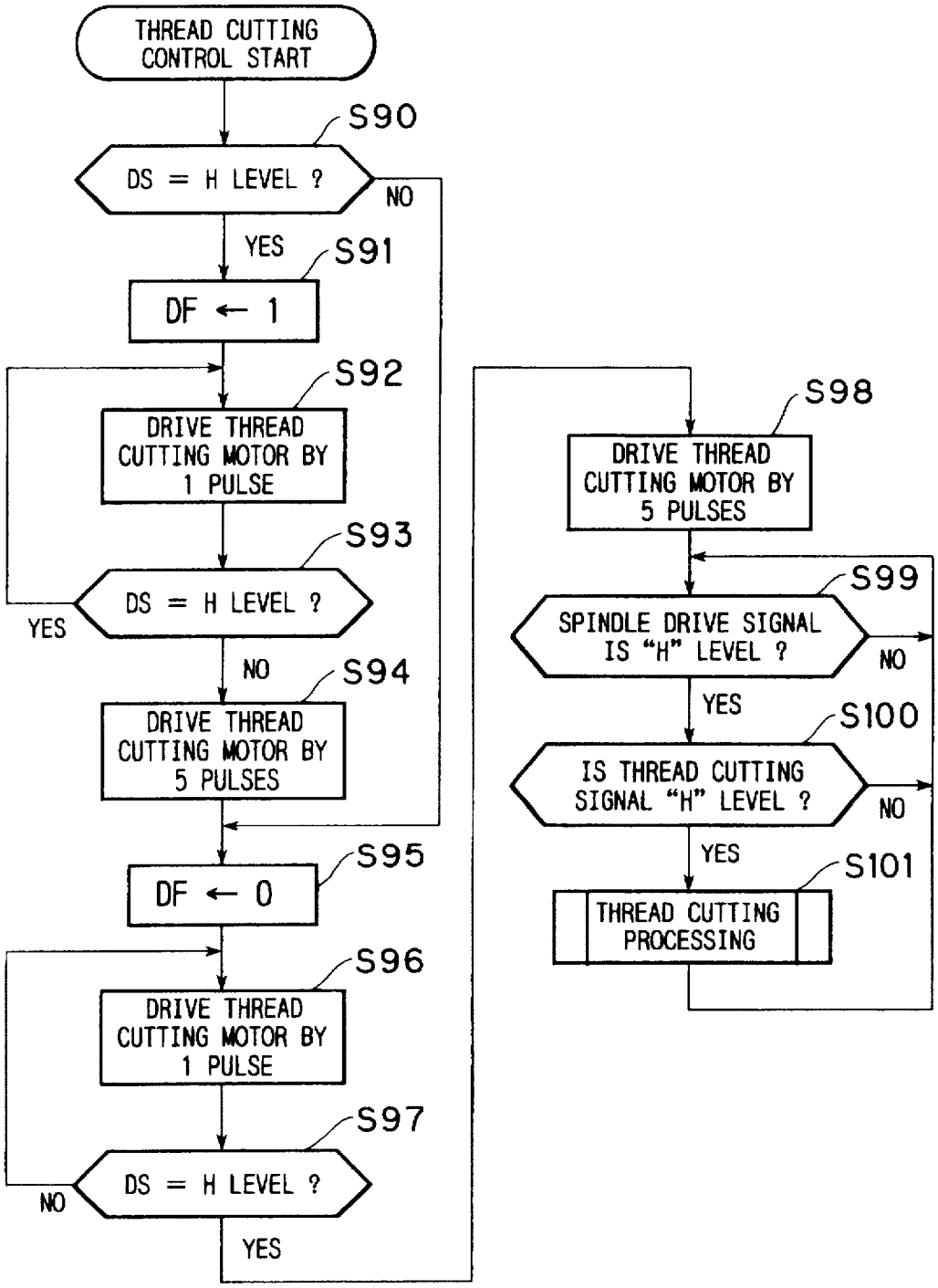
FIG. 16 is a flowchart showing a thread cutting control routine according to the embodiment.

Next, thread cutting processing will be described with reference to FIGS. 16 and 17. The thread cutting processing is executed in a thread cutting control started concurrently with the above described remaining thread length providing processing upon turning ON the electrical power supply.

If the electrical power is supplied to the multiple head type embroidery machine M, this thread cutting control will be started. Firstly, initial setting with respect to the movable blade 81 is executed through the steps S90 through S98. That is, if the moving position detection signal DS transmitted from the moving position detection sensor 94 is "H" level, i.e., the movable blade 81 is positioned at its cutting position upon detection of the shield plate 95 by the sensor 94 (S90:Yes), a flag DF of "1" is set which is indicative of outward or one way moving direction of the thread cutting motor 88 (S91). The thread cutting motor 88 is driven at every one pulse until the moving position detection signal DS becomes "L" level, i. e., the movable blade 81 is moved from its cutting position to a predetermined angular position in the outward or one way direction (S92, S93).

If the moving position detecting signal DS becomes "L" level (S93:No), the thread cutting motor 88 is further driven by 5 pulses, so that the movable blade 81 is further moved by a minute angular amount in the outward or one way direction (S94). Then, a flag DF of "0" is set which is indicative of a driving of the thread cutting motor 88 in a returning direction (S95), and the thread cutting motor 88 is driven at every one pulse until the moving position detection signal DS becomes "H" level, i. e., until the movable blade 81 is moved to its cutting position(S96, S97). If the moving position detecting signal DS becomes "H" level (S7:Yes), the thread cutting motor 88 is further driven by 5 pulses, so that the movable blade 81 is further moved by a minute amount in the returning direction (S98).

Then, if the "H" level spindle drive signal is transmitted from the sewing machine control device 100 (S99:Yes), steps S99 and S100 are repeatedly executed until the thread cutting signal is transmitted from the sewing machine control device 100. At the final Nth number of stitch if the thread cutting signal is transmitted when the rotation angle of the spindle 17 is about 260° (S100:Yes), thread cutting processing will be executed (S101) as shown in a flowchart of FIG. 17.

Figure 24:
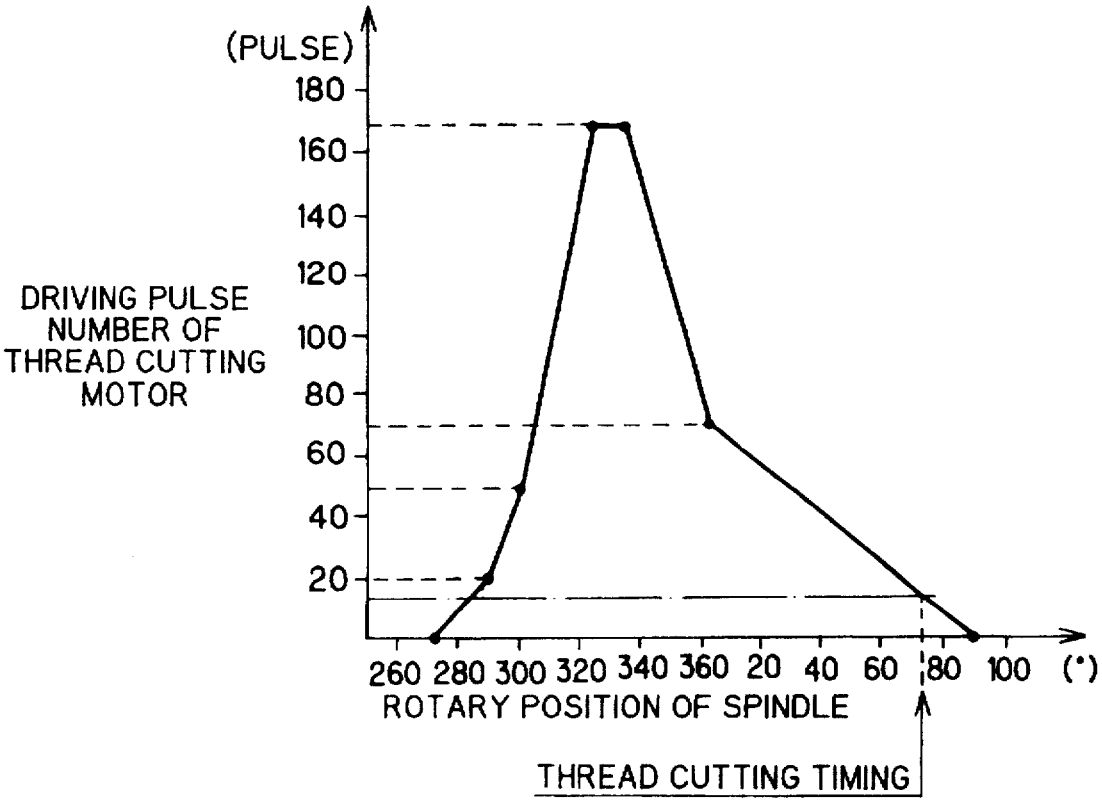
FIG. 24 is a graphical representation showing the relationship between a driving pulse number of a thread cutting motor and rotating position of the spindle according to the embodiment.

In the thread cutting processing, if the rotary position of the spindle 17 becomes 270° (S110:Yes), flag DF indicative of the driving direction is set (S111), and the thread cutting motor 88 is consecutively driven by totally 20 pulses wherein each driving of the thread cutting motor 88 by one pulse is performed upon counting 11 pulses of the spindle rotation signals through steps S112 and S113 as shown in FIG. 24.

If the thread cutting motor 88 is driven by 20 pulses (S113:Yes), the thread cutting motor 88 is consecutively driven by totally 27 pulses wherein each driving of the thread cutting motor 88 by one pulse is performed upon counting 4 pulses of the spindle rotation signals through steps S114 and S115. Then, if the thread cutting motor 88 is driven by 27 pulses (S115:Yes), the thread cutting motor 88 is consecutively driven by totally 121 pulses wherein each driving of the thread cutting motor 88 by one pulse is performed upon counting 2 pulses of the spindle rotation signals through steps S116 and S117. While driving the cutting motor 88 by 121 pulses, the needle thread 47*a* extending from the needle 22 and disengaged from the bifurcated thread guide portion 59*c* (FIG. 23) is separated, by the movable blade 81, from the bobbin thread 48 and the needle thread 47*b* stitched into the workpiece fabric W, the bifurcated thread guide portion 59*c* being positioned in confrontation with the loop seizing beak 59*b* provided at outer peripheral portion of the outer rotary hook 59*a* of the rotary hook 59.

Figure 25:
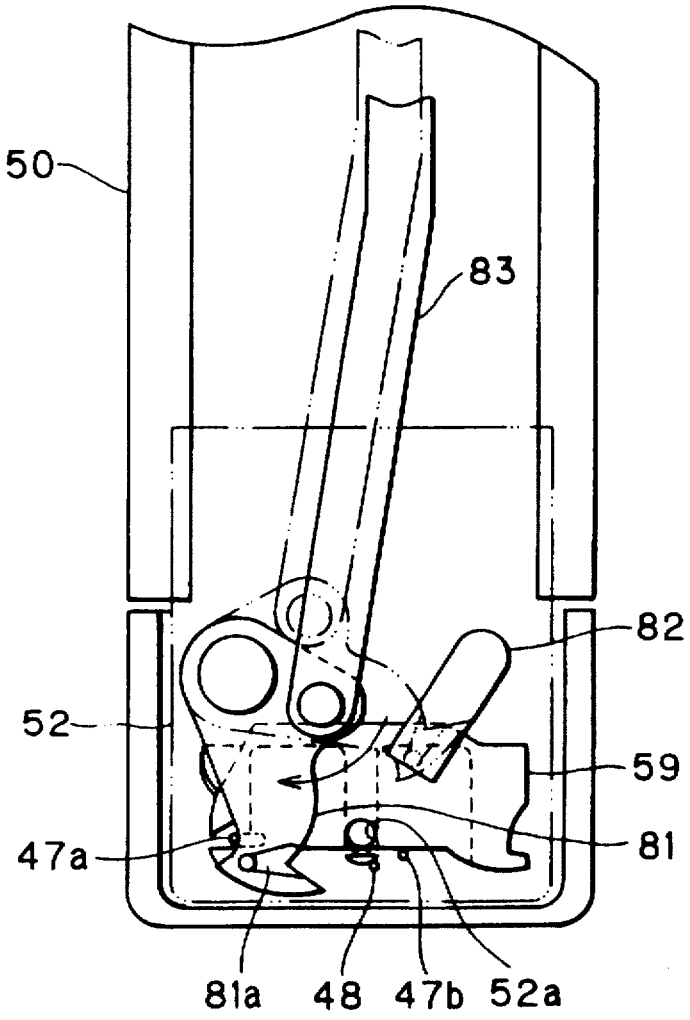
FIG. 25 is an enlarged plan view showing the front portion of the bed unit in which a movable blade is pivotally moved to its maximum pivot position engageable with a needle thread and a bobbin thread according to the embodiment.

After the thread cutting motor 88 has been driven by 121 pulses, as shown in FIG. 25, the movable blade 81 is moved to its maximum pivot position where the movable blade 81 is engageable with the bobbin thread 48 and the needle thread 47*b* stitched into the workpiece fabric W. Incidentally, FIG. 25 shows geometrical relationship among the needle thread 47*a* extending from the needle 22, the needle thread 47*b* stitched into the workpiece fabric W and the bobbin thread 48, those being viewed in a horizontal plane.

Then, rotation of the thread cutting motor 88 is stopped until the spindle 17 is rotated to its rotational position of 335° at which the hook shaft 60 is rotated at high speed proportional to the rotation speed of the spindle 17 as described above (S118:No). If the rotational position of the spindle 17 becomes 335° (S118:Yes), the drive direction flag DF is subjected to re-setting in order to move the movable blade 81 in the opposite direction (S119). Then, the thread cutting motor 88 is consecutively driven by totally 100 pulses wherein each driving of the thread cutting motor 88 by one pulse is performed upon counting 3 pulses of the spindle rotation signals. In this case, the bobbin thread. 4 and the needle thread 47*b* stitched into the workpiece fabric are engaged with the engaging portion 81*a* of the movable blade 81.

After driving the thread cutting motor 88 by 100 pulses (S121:Yes), every one pulse driving of the thread cutting motor 88 upon counting 14 pulses of the spindle rotation signals is repeatedly performed until the moving position detecting signal DS becomes "H" level (S122, S123). At the thread cutting timing shown by a dotted chain line in FIG. 24, the needle thread 47 and the bobbin thread 48 are cut simultaneously by the movable blade 81 and the stationary blade 82. Further, the thread cutting motor is driven by 5 pulses, so that the movable blade 81 is further slightly moved to its returning direction (S124, S125).

Figure 26:
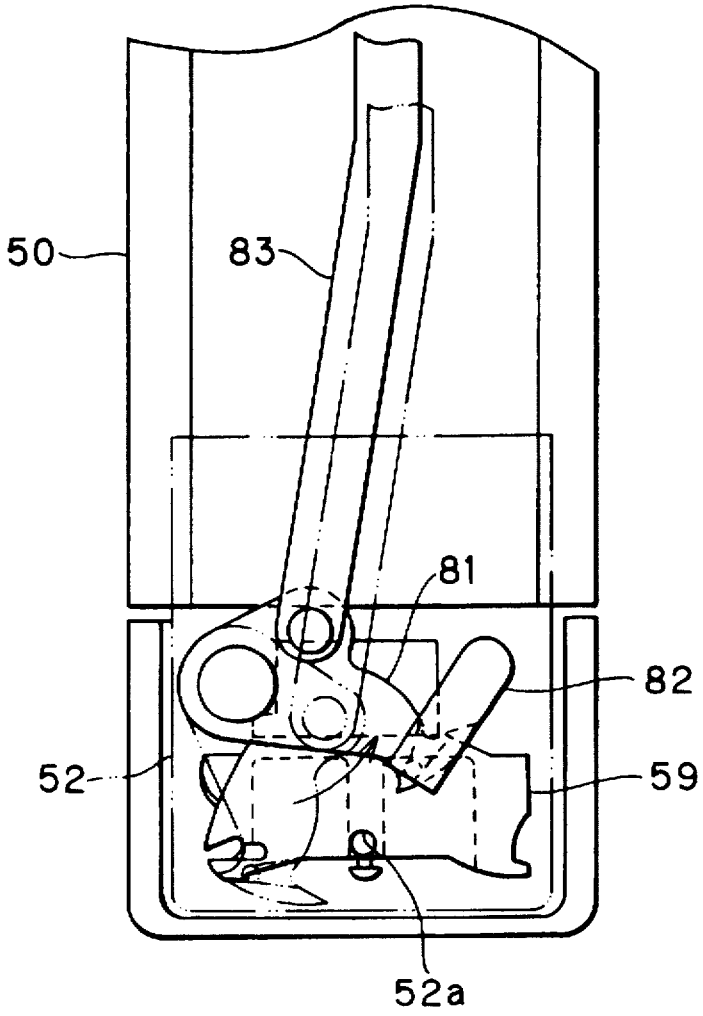
FIG. 26 is an enlarged plan view showing the front portion of the bed unit in which the movable blade is pivotally moved toward its standby position for cutting the needle thread and bobbin thread according to the embodiment.

The pivotal movement of the movable blade by the 5-pulse driving of the thread cutting motor 88 (S125:Yes) implies the completion of the initial setting of the movable blade 81. Then, the processing is ended and the routine returns back to S 99 in the thread cutting control routine to wait for the input of the subsequent thread cutting signal. In this instance, as shown in FIG. 26, the movable blade 81 is at its original stand-by position as a result of one way movement thereof. A cut end portion of the bobbin thread 48 is held by the bobbin thread holding portion (not shown) provided at the lower side of the stationary blade 82.

As shown in FIGS. 22 and 24, in the thread cutting timing, the rotary hook 59 is rotated at high speed in proportion to the rotation speed of the spindle 17 and the needle thread loop 47*c* is promptly disengaged from the rotary hook 59 at the predetermined rotational position of the spindle 17. Therefore, the disengaging timing of the needle thread loop 47*c* from the rotary hook 59 can be concentrated to a predetermined timing, and further, the remaining needle thread passing through the eyelet of the needle can have a sufficient length capable of preventing the remaining length portion from being disengaged from the eyelet of the needle 22 in a starting phase at a subsequent stitching operation.

Figure 27:
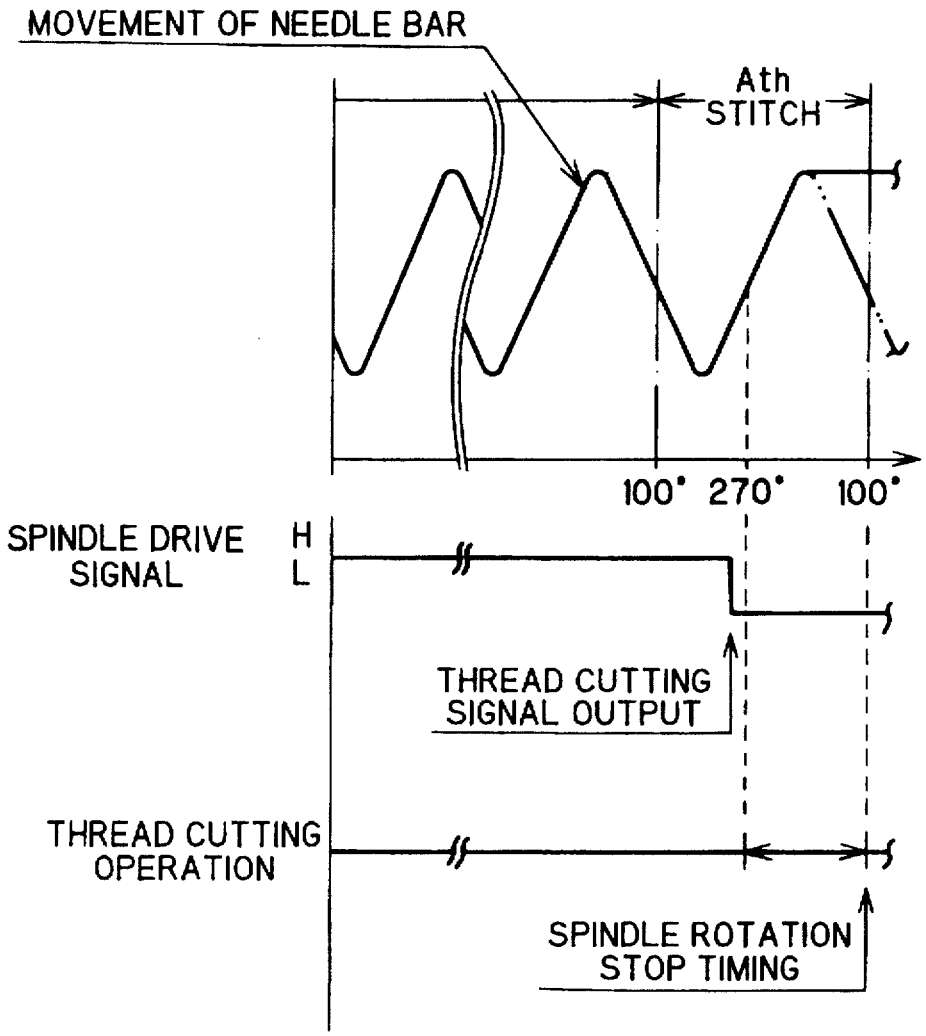
FIG. 27 is a time chart showing the relationship between the various signals and rotation angles of a spindle for description of the needle thread timing during the middle of the stitching operation according to the embodiment.
Figure 28:
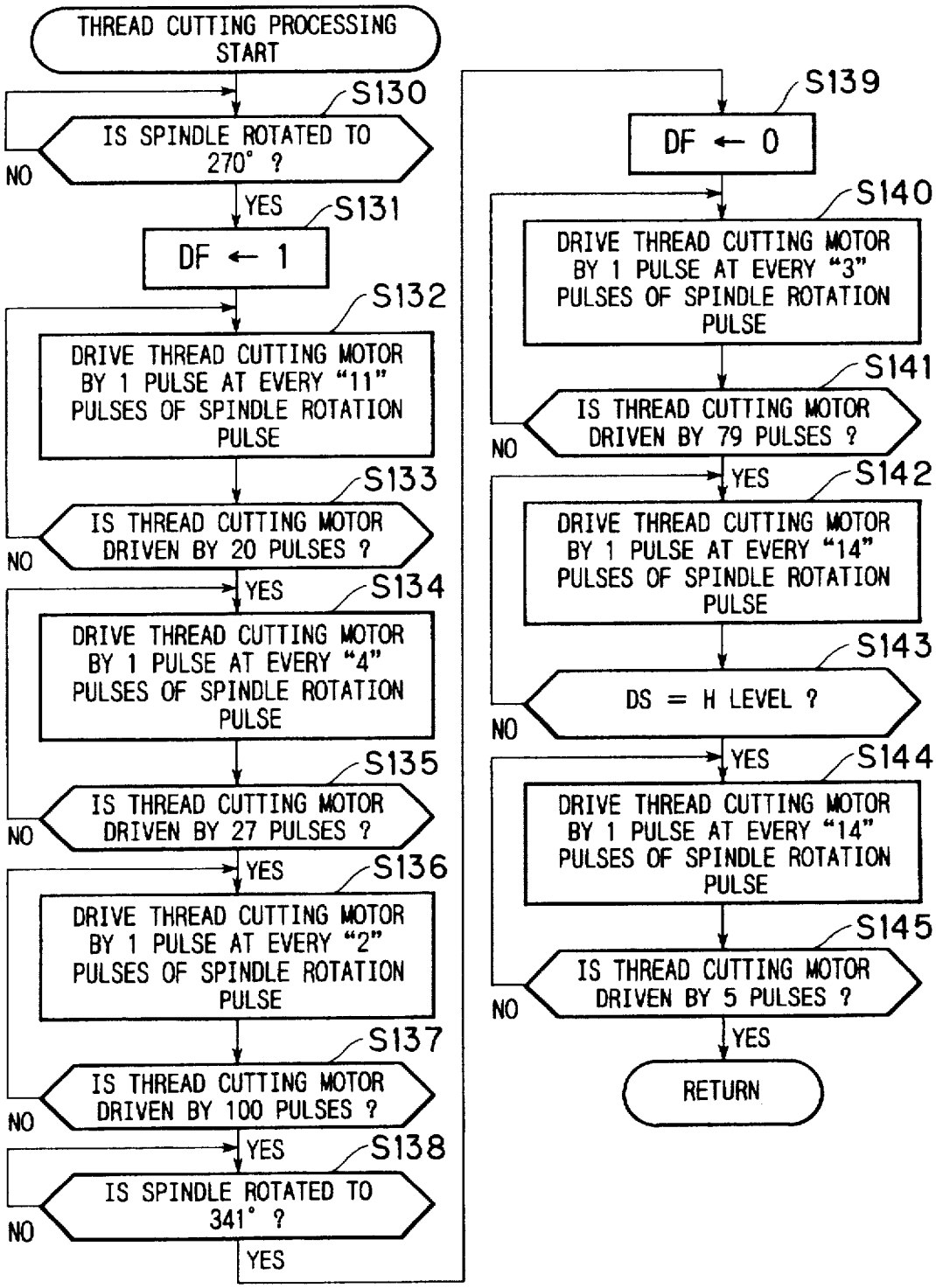
FIG. 28 is a flowchart showing a needle thread cutting processing routine according to the embodiment.

As shown in FIG. 27, if the needle thread cutting signal is transmitted from the sewing machine control device 100 for changing the present needle thread with another needle thread in the middle of the embroidery stitching operation, for example, at A-th number of stitch, only the needle thread cutting process routine shown in FIG. 28 will be executed.

Figure 17:
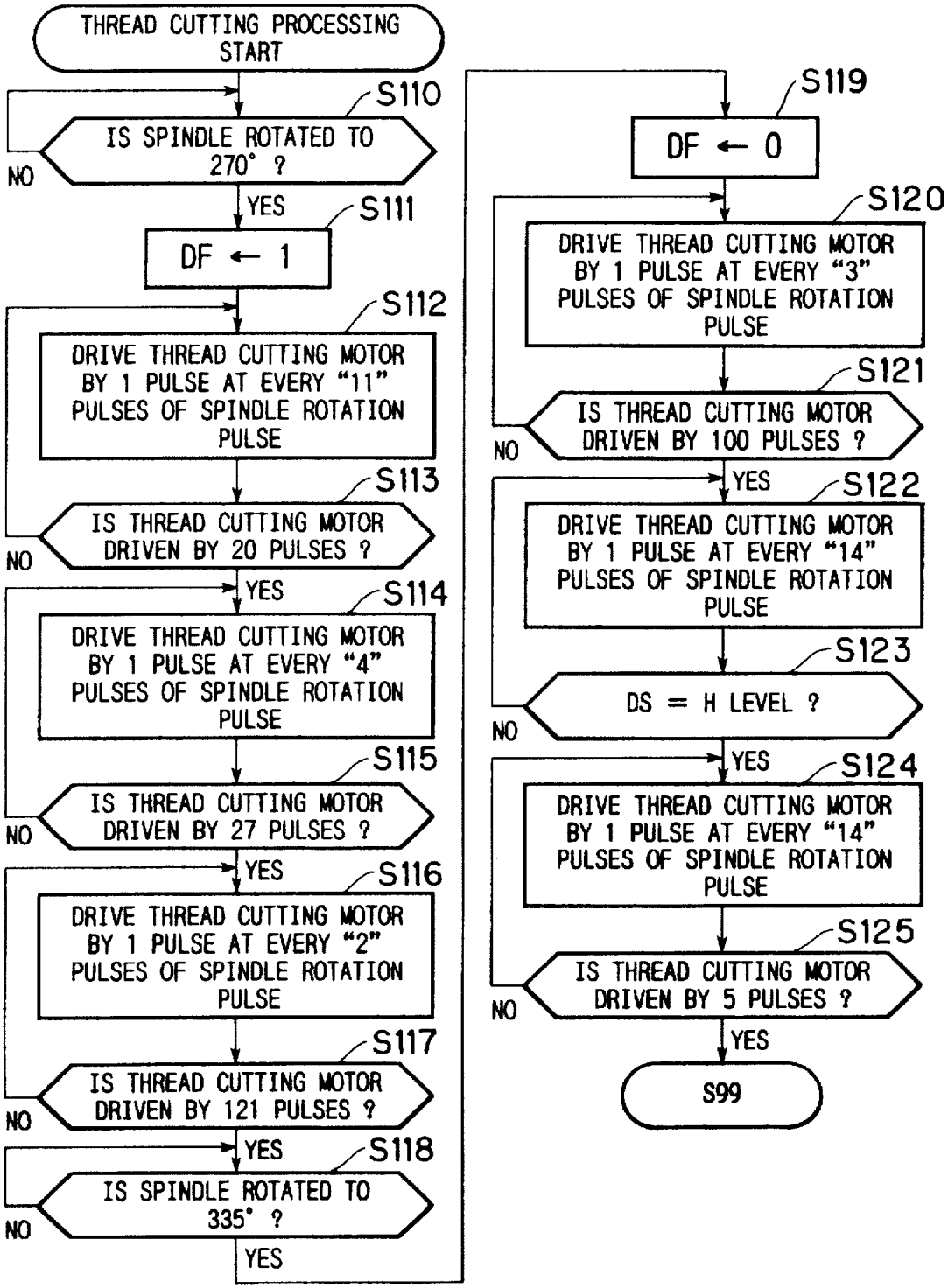
FIG. 17 is a flowchart showing a thread cutting processing routine which is a subroutine of the thread cutting control routine shown in FIG. 16.
Figure 29:
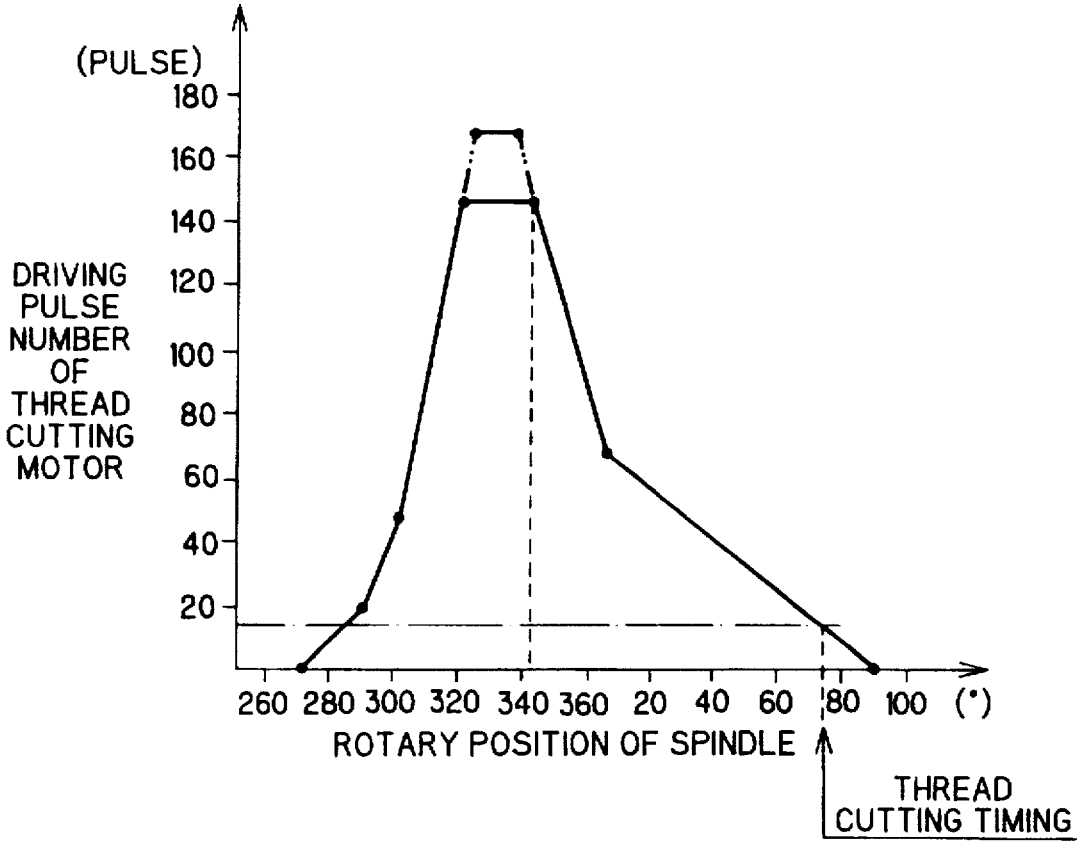
FIG. 29 is a graphical representation showing the relationship between a driving pulse number of a thread cutting motor and a rotating position of the spindle for description of the needle thread cutting timing according to the embodiment.

The needle thread cutting routine is almost the same as the thread cutting processing routine shown in FIG. 17. However, as shown in FIG. 29, the movable blade 81 is not moved to its maximum pivot position (in FIG. 29, the two dotted chain line implies the maximum pivot position also shown in FIG. 24), so that only the needle thread stitched into and extending from the workpiece fabric is latched by the movable blade and is cut by the movable and stationary blades.

Figure 30:
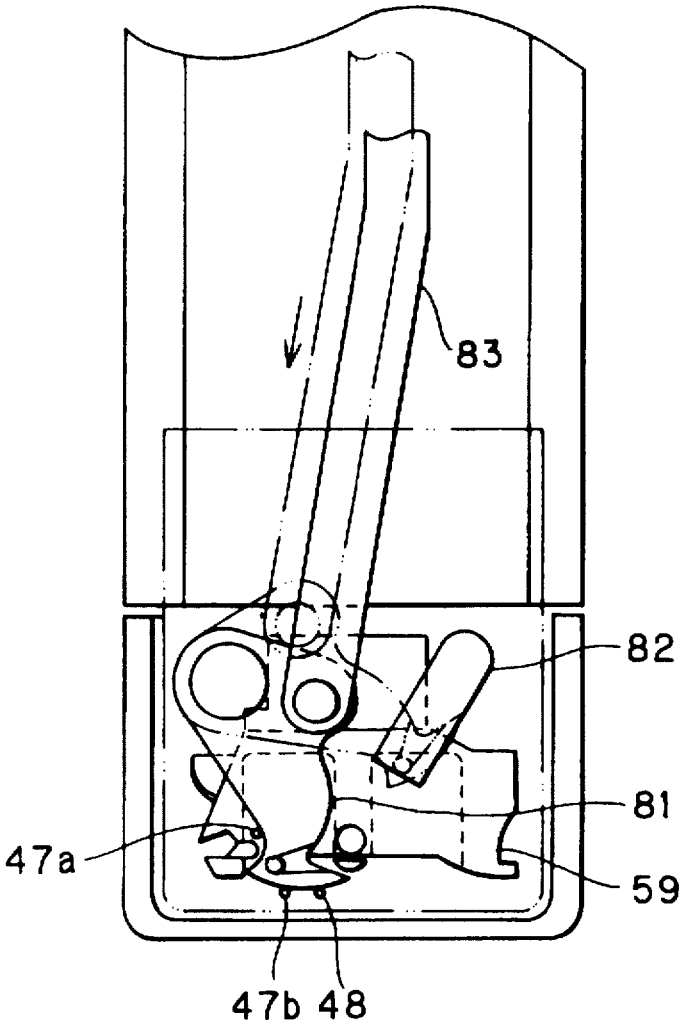
FIG. 30 is an enlarged plan view showing a geometrical relationship among a temporarily stopped movable blade, a bobbin thread, a needle thread already stitched into the fabric and the needle thread unstitched into the workpiece fabric for description of the needle thread cutting operation according to the embodiment of the present invention.

More specifically, when this routine is started, the steps S130 through S135 are executed, these being identical with the steps S110 through S115 of the thread cutting processing routine shown in FIG. 17. Then, through steps S136 and S137, the thread cutting motor 88 is consecutively driven by totally 100 pulses wherein each driving of the thread cutting motor 88 by one pulse is performed upon counting 2 pulses of the spindle rotation signals. That is, as a result of the rotation of the thread cutting motor 88 by 100 pulses, the needle thread 47 is disengaged from the bifurcated thread guide portion 59*c* provided at the outer rotary hook 59*a* of the rotary hook 59, and further, the needle thread 47*a* extending from the eyelet of the needle 22 is separated, by the movable blade 81, from the bobbin thread 47 and the needle thread 47*b* extending from the workpiece fabric. In this state, the movable blade 81 is not moved to its maximum pivot position as shown in FIG. 30 where the bobbin thread 48 and the needle thread 47*b* extending from the workpiece fabric have not yet been engaged with but are about to be engaged with the movable blade 81.

Figure 31:
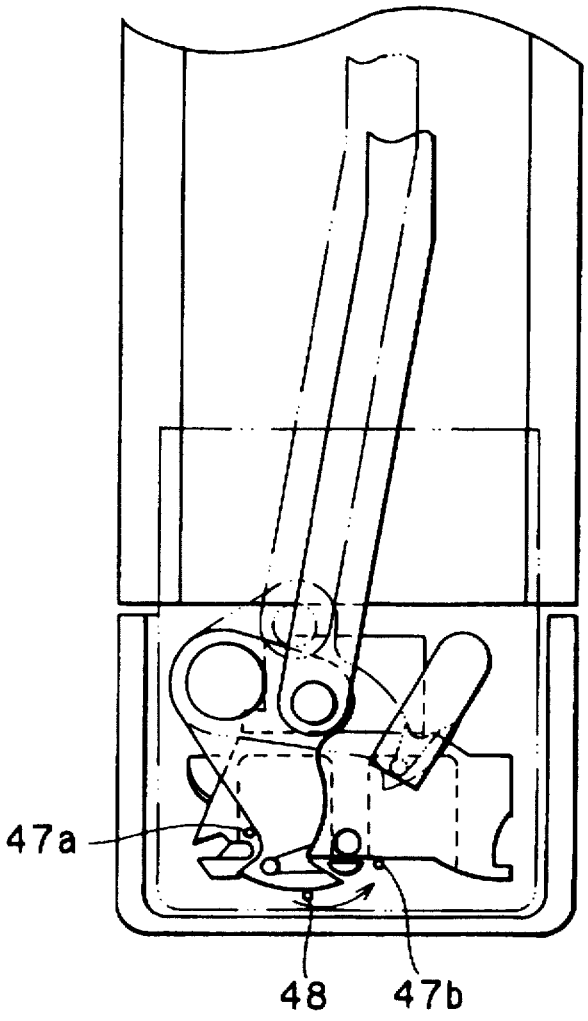
FIG. 31 is an enlarged plan view showing a state where the needle thread stitched into the workpiece fabric is to be engaged with the movable blade according to the embodiment.

Then, if the rotation angle of the spindle 17 becomes 341 (S138:Yes), through steps S139 and S141, the thread cutting motor 88 is reversibly driven by totally 79 pulses wherein each driving of the thread cutting motor 88 by one pulse is performed upon counting 3 pulses of the spindle rotation signals. As a result, the movable blade 81 is moved to its returning position while the rotary hook 59 is rotated to provide the needle thread latching timing. That is, from the state shown in FIG. 30 to the state shown in FIG. 31, only the needle thread 47*b* stitched into the workpiece fabric is moved to a position engageable with the movable blade 81 in accordance with the rotation of the rotary hook, i.e., in accordance with the movement of the loop seizing beak 59*b*. Then, step S142 through S145, those being the same as the steps S 122 through S125, are executed, so that only the needle thread 47*b* extending from the workpiece fabric can be cut during the return stroke of the movable blade 81 toward its stand-by position in cooperation with the stationary blade 82.

Therefore, at the re-starting timing of stitching after the needle thread cutting operation, the bobbin thread 48 is still connected to the workpiece fabric. Therefore, subsequent stitching operation can be smoothly performed by ensuring engagement between the bobbin thread 48 and the needle thread 47. Thus, seam can surely be formed at the re-start timing of stitching.

While the invention has been described in detail and with reference to the specific embodiments thereof, it would be apparent to those skilled in the art that various changes and modifications may be made therein without departing from the spirit and scope of the invention. For example, in the depicted embodiment, the rotary hook drive motor is provided independent of the sewing machine motor. However, the hook shaft which drives the rotary hook 59 can be driven in interlocking relation with the spindle 17. Further, instead of the thread cutting motor 88, a rotary solenoid or other type of actuator is available which can alter the rotary driving amount for driving the movable blade 81. Furthermore, the present invention can be applied to a various types of sewing machines such as a single embroidery machine having a thread cutting mechanism driven independently of the sewing machine motor. Moreover, various kind of drive motors can be applied to the sewing machine motor 110 and the rotary hook drive motor 58. For example, a stepping motor is available as the sewing machine motor 110, and an AC servo motor is available as the rotary hook drive motor 58.

What is claimed is:

1. A sewing machine for stitching a workpiece fabric with a needle thread and a bobbin thread, the sewing machine comprising:

a sewing machine motor;

a spindle driven by the sewing machine motor for driving a needle;

a bed having a throat plate;

a rotary hook provided in the bed for trapping a needle thread loop in cooperation with the needle;

a thread cutting mechanism disposed below the throat plate for cutting the needle thread and the bobbin thread, the thread cutting mechanism comprising a movable blade connected to the actuator and a stationary blade, the movable blade being movable between a first position positioned remote from the stationary blade and a second position positioned adjacent the stationary blade, the needle thread and the bobbin thread being cut simultaneously when the movable blade is moved from the first position to the second position;

an actuator for driving the thread cutting mechanism independent of the sewing machine motor; and control means for controlling the actuator so that only a needle thread stitched into and extending from the workpiece fabric is cut by the thread cutting mechanism without cutting the bobbin thread the control means comprising first means for stopping the movable blade to a third position positioned between the first and second position and close to the first position, in the third position the needle thread and the bobbin thread being about to be engaged with the movable blade, second means for moving the movable blade from the third position to the second position, and third means for moving the needle thread to a position engagable with the movable blade when the movable blade is moved from the third position to the second position.

2. The sewing machine as claimed in claim 1, wherein the movable blade is pivotally movable between a maximum pivot position and a standby position adjacent the stationary blade, the first position being the maximum pivot position, and the second position being the standby position.

3. The sewing machine as claimed in claim 2, wherein the rotary hook comprises a rotary hook body, a loop seizing beak provided to the rotary hook body and with which the needle thread is engageable for forming the needle thread loop, and a thread guiding portion for permitting the needle thread to be engaged with the loop seizing beak, and wherein the third means comprises a rotary hook drive motor for rotating the rotary hook, rotation of the rotary hook body providing movement of the loop seizing beak thereby moving the needle thread to the position engageable with the movable blade.

4. The sewing machine as claimed in claim 3, wherein the needle thread and the bobbin thread are engageable with the movable blade if the movable blade is moved from the first position to the second position.

5. The sewing machine as claimed in claim 3, wherein the rotary hook drive motor is provided independent of the sewing machine motor and is rotatable in synchronization with the spindle at a synchronous rotation speed.

6. The sewing machine as claimed in claim 5, wherein the needle has a eyelet through which the needle thread passes, and the sewing machine further comprising a control section controlling rotation of the rotary hook drive motor in accordance with a predetermined rotation angle of the spindle so that a residual leading end part of the needle thread passing through the eyelet can has a length capable of avoiding release of the residual leading end part from the eyelet of the needle in cutting the thread by the thread cutting mechanism.

7. The sewing machine as claimed in claim 6, wherein the control section comprises means for temporarily stopping rotation of the rotary hook drive motor during a predetermined period starting from a predetermined timing prior to an actual thread cutting operation.

8. The sewing machine as claimed in claim 7, wherein the predetermined period corresponds to a predetermined range of rotation angle of the spindle.

9. The sewing machine as claimed in claim 8, wherein the control section further comprises means for setting rotation speed of the rotary hook drive motor higher than the synchronous rotation speed thereof when the rotary hook drive motor is re-started after the rotary hook drive motor is temporarily stopped by the temporarily stopping means.

10. The sewing machine as claimed in claim 9, wherein the higher rotation speed of the rotary hook is proportional to the rotation speed of the spindle.

11. The sewing machine as claimed in claim 10, wherein the synchronous rotation speed of the rotary hook is twice as high as the rotation speed of the spindle.

12. The sewing machine as claimed in claim 1, wherein the rotary hook comprises a rotary hook body, a loop seizing beak provided to the rotary hook body and with which the needle thread is engageable for forming the needle thread loop, and a thread guiding portion for permitting the needle thread to be engaged with the loop seizing beak.

13. The sewing machine as claimed in claim 1, wherein the actuator comprises a stepping motor, and a power transmission mechanism for transmitting a driving power of the stepping motor to the movable blade.

14. The sewing machine as claimed in claim 1, further comprising a rotary hook drive motor coupled to the rotary hook for rotating the rotary hook, and wherein the bed comprises:

an elongated bed case extending in a frontward/backward direction, the rotary hook drive motor and the rotary hook being disposed in in-line fashion in the bed case and the throat plate being mounted on the bed case at a position above the rotary hook and at a frontward portion of the bed case, the throat plate being formed with a needle hole, and a protection cover pivotally supported to the frontward portion of the bed case for defining a frontmost end of the bed, the rotary hook being in direct confrontation with the protection cover for minimizing a distance between the needle hole and the frontmost end.

15. The sewing machine as claimed in claim 6, wherein the control section further comprises means for controlling rotation of the rotary hook drive motor so that the residual leading end part of the needle thread appearing at a top side of the workpiece fabric is drawn into a bottom side thereof at a stitch starting timing.

16. The sewing machine as claimed in claim 15, further comprising a thread take-up lever driven by the spindle and a reciprocally movable in a vertical direction, and wherein the stitch starting timing corresponds to upwardly moving period of the thread take-up lever.

* * * * *